US008219008B2

(12) United States Patent
Tanaka

(10) Patent No.: US 8,219,008 B2
(45) Date of Patent: Jul. 10, 2012

(54) POWDER SUPPLY UNIT, MANUFACTURING METHOD OF THE POWDER SUPPLY UNIT, AND RECYCLING METHOD OF THE POWDER SUPPLY UNIT

(75) Inventor: Hideaki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 991 days.

(21) Appl. No.: 11/636,467

(22) Filed: Dec. 11, 2006

(65) Prior Publication Data

US 2007/0280739 A1 Dec. 6, 2007

(30) Foreign Application Priority Data

Jun. 2, 2006 (JP) ..... 2006-154409

(51) Int. Cl.
*G03G 15/08* (2006.01)

(52) U.S. Cl. ..... 399/254

(58) Field of Classification Search ..... 399/119, 399/252, 254, 255, 258, 262, 263, 256
See application file for complete search history.

(56) References Cited

U.S. PATENT DOCUMENTS

| | | | | |
|---|---|---|---|---|
| 6,246,854 | B1 * | 6/2001 | Kurosawa et al. | 399/263 |
| 6,477,336 | B2 * | 11/2002 | Hibi | |
| 6,553,189 | B2 * | 4/2003 | Miyamoto et al. | |
| 2001/0021314 | A1 | 9/2001 | Hibi | |
| 2002/0021919 | A1 | 2/2002 | Tamaki et al. | |
| 2005/0025544 | A1 | 2/2005 | Yamashita et al. | |
| 2006/0216063 | A1 * | 9/2006 | Okoshi | |
| 2006/0216067 | A1 * | 9/2006 | Okoshi | 399/258 |
| 2006/0222412 | A1 * | 10/2006 | Ito et al. | 399/258 |
| 2006/0222414 | A1 * | 10/2006 | Yamamura | 399/263 |

FOREIGN PATENT DOCUMENTS

| | | | | |
|---|---|---|---|---|
| JP | 8016066 | A | | 1/1996 |
| JP | 10239970 | A | * | 9/1998 |
| JP | 10282774 | A | * | 10/1998 |
| JP | 11044997 | A | * | 2/1999 |
| JP | 11143232 | A | * | 5/1999 |
| JP | 2000047466 | A | | 2/2000 |
| JP | 2001-305847 | A | | 11/2001 |
| JP | 2001-350335 | A | | 12/2001 |
| JP | 2002040786 | A | * | 2/2002 |
| JP | 2002236410 | A | * | 8/2002 |
| JP | 2002244422 | A | * | 8/2002 |
| JP | 2002296887 | A | * | 10/2002 |
| JP | 2003005500 | A | | 1/2003 |
| JP | 2004-198800 | A | | 7/2004 |
| JP | 2004-264674 | A | | 9/2004 |
| JP | 2004286939 | A | | 10/2004 |
| JP | 2005049543 | A | | 2/2005 |
| JP | 2005070702 | A | * | 3/2005 |
| JP | 2005077572 | A | * | 3/2005 |
| JP | 2006065084 | A | | 3/2006 |

* cited by examiner

*Primary Examiner* — David Porta
*Assistant Examiner* — Milton Gonzalez
(74) *Attorney, Agent, or Firm* — Sughrue Mion, PLLC

(57) ABSTRACT

A powder supply unit is disclosed, which includes a housing accommodating powder, a rotating member rotatably provided in the housing, a sheet-like transporting member fixed to the rotating member and having a free end at a side different from the fixed portion side and slidingly moved on an inner wall of the housing by the rotation of the rotating member to transport the powder in the axial direction of the rotating member, and a powder supplying hole provided on the downstream side in the transporting direction of the powder in the housing. The powder supply unit is constructed such that the transporting member, when not in use, is in a hold state in which the free end side thereof is bent in a direction opposite to the direction of bending when in use.

6 Claims, 10 Drawing Sheets

POWDER SUPPLY UNIT, MANUFACTURING METHOD OF THE POWDER SUPPLY UNIT, AND RECYCLING METHOD OF THE POWDER SUPPLY UNIT

BACKGROUND

1. Technical Field

The present invention relates to a powder supply unit wherein powder is stirred by rotation of a rotating member such as an agitator or the like in a vessel in which the powder is stored and wherein the powder is transported to a powder supplying hole, a manufacturing method of the powder supply unit, and a recycling method of the powder supply unit.

2. Related Art

Conventionally, widely used is an image formation apparatus such as a copying machine, a printer, and the like, having a photosensitive drum, a developing device (powder supply unit) which has an accommodating part in which toner is accommodated and which sends out toner from an outlet provided at the front thereof to supply it to the photosensitive drum, a charging device, a transfer device of toner to paper, a cleaning device, and a fixation device for performing fixation to paper.

The photosensitive drum, developing device, charging device, and cleaning device are fabricated as a unit, and are provided as a process cartridge in an exchangeable manner.

In the process cartridge, provided is an agitator as a stirring/transporting means which stirs toner in the accommodating part and in which a toner stirring means and a toner transporting means for transporting toner to an outlet are integrally formed.

Here, as a first example of the agitator, proposed is an agitator which has a stirring member attached to a rotation drive shaft and a transportation sheet attached to one end of the stirring member and in which a thin plate metal member is employed for the transportation sheet to promote an elasticity restoring force against curvature deformation in order to prevent a toner transport force from being deteriorated.

However, in the agitator described above in the paragraph, although it is advantageous because it does not have a weakness for bending at the time of preservation as in the case of a film sheet, since a metal member is employed for the transportation sheet, it costs more compared to an ordinary film sheet. Further, since it is a metal member, a fold and the like is easy to be made at the time of manufacturing, and there is a problem of non-uniformity in the toner transportation.

As a second example of the agitator, proposed is an agitator which has a rotating member and a sheet member for stirring and transporting toner and in which the rotating member and sheet member are distinct bodies before use such that when the rotating member rotates at the time of start of use, the rotating member is coupled with the sheet member to become a unit.

However, in the agitator described above in the paragraph, since there is play in the coupling part of the rotating member and the sheet member, the sheet member moves in a direction of an angle in which the sheet member moves out of the toner transporting direction, whereby there are problems that toner transportation performance cannot be sufficiently ensured, and the amount of remaining toner becomes large.

As a third example of the agitator, proposed is an agitator which is provided with a sliding member having a small frictional resistance on a distal end of the transportation sheet and in which the transportation sheet is set so as to be larger than the rotation radius of the stirring member and so as to have a length to slide on the inner wall of a toner replenishment vessel.

However, in the agitator described above in the paragraph, the sliding member has to be attached to the distal end portion that is folded and bent, so high fabrication accuracy is required giving poor assembleability, whereby there is a problem that manufacturing costs become high. Further, when there is a defect in attaching of the sliding member, there is a problem that deficiencies in toner transportation occur.

SUMMARY

The present invention has been made in consideration of the above described facts, and provides a powder supply unit employing a sheet-like transporting member in which before the use is started a curl tendency, in the same direction as that when used, is prevented from being made in the sheet-like transporting member, so that deterioration of powder transport force can be prevented. A manufacturing method of the powder supply unit, and a recycling method of the powder supply unit.

According to an aspect of the invention, there is provided a powder supply unit comprising a housing accommodating powder, a rotating member rotatably arranged in the housing, a sheet-like transporting member being fixed on the rotating member and having a free end at a side different from the fixed portion side and which slides and moves on an inner wall of the housing by the rotation of the rotating member, transporting the powder in the axial direction of the rotating member, and a powder supplying hole provided on the downstream side in the transporting direction of the powder in the housing, the transporting member when not in use being in a hold state in which the free end side thereof is bent in a direction opposite to the direction of bending when in use.

Other aspects, features, and advantages of the invention will become apparent from the following description taken in conjunction with the accompanying drawings.

BRIEF DESCRIPTION OF THE DRAWINGS

Exemplary embodiments of the invention will be described in detail based on the following figures, in which.

DETAILED DESCRIPTION

A first exemplary embodiment of the powder supply unit, manufacturing method of the powder supply unit, and recycling method of the powder supply unit of the invention will be described below with reference to the drawings.

Figure 1:
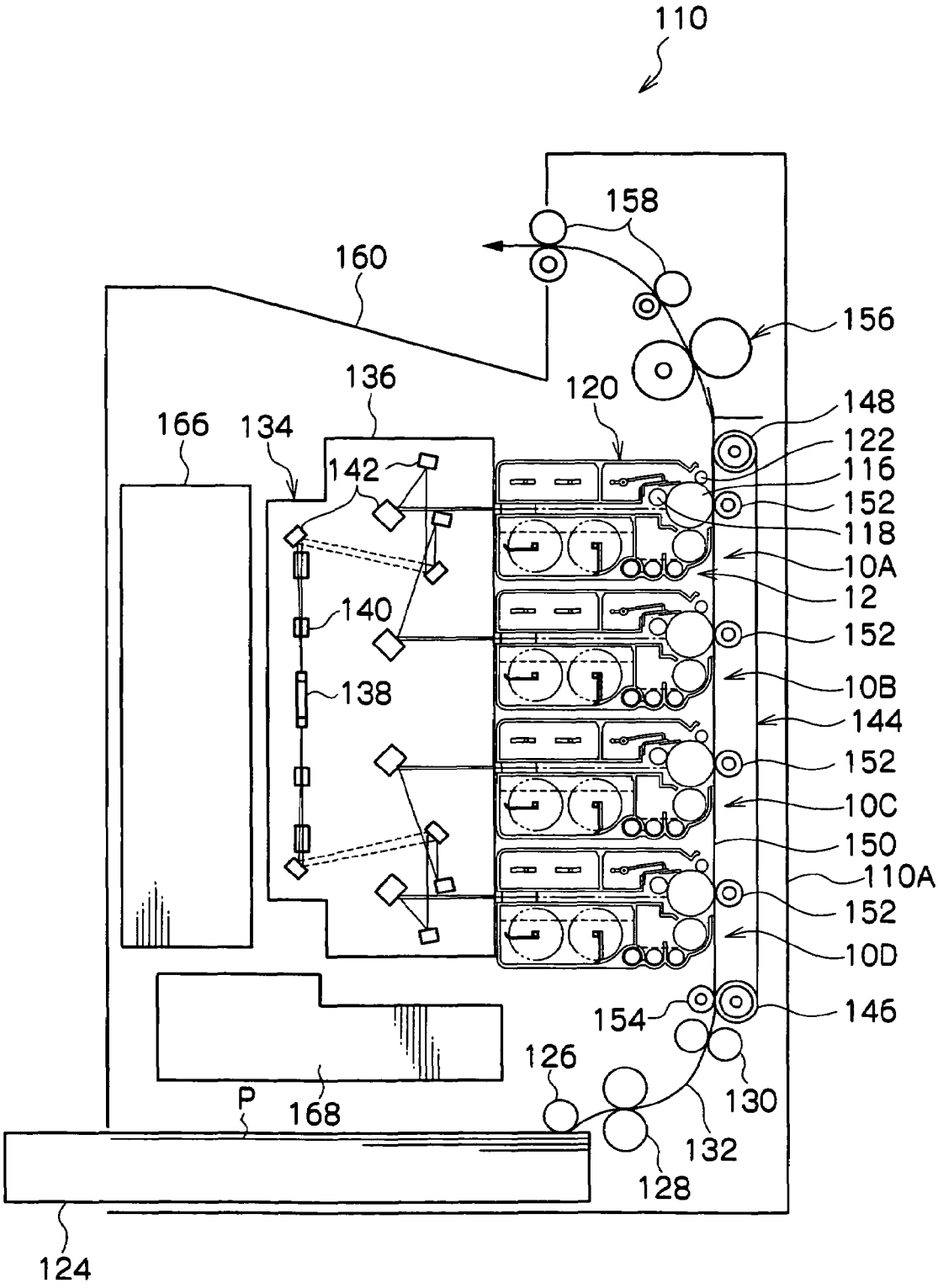
FIG. 1 is a cross-sectional view of a printer into which a developing device of the invention is loaded.

FIG. 1 shows a printer 110 into which developing devices 10A, 10B, 10C, and 10D as powder supply units of the invention are loaded.

In the printer 110, process cartridges 120 executing full color image formation by four color toners (yellow (Y), magenta (M), cyan (C), and black (K)) are arranged corresponding to the respective colors in the up and down direction.

The respective toners, Y, M, C, and K are not particularly limited by their manufacturing method, and various kinds of toners can be employed.

For example, toner manufacturing methods that can be employed include: kneading-grinding methods in which a binder resin, coloring agent, releasing agent, and, as the need arises, a charging controller, and the like are kneaded, ground, and classified; methods in which the shape of particles obtained through a kneading-grinding method is changed by mechanical impact or heat energy; emulsion polymerization agglomeration methods in which a dispersion liquid, formed by emulsifying a polymerizable monomer of a binder resin and a dispersion liquid such as a coloring agent, releasing agent, and, as the need arises, a charging controller are mixed, agglomerated, and heated to be fusion-bonded to yield toner particles; a suspension polymerization method in which a polymerizable monomer for obtaining a binder resin and coloring agent, releasing agent, and, as the need arises, a solution of a charging controller or the like are suspended in an aqueous solvent and polymerized: or dissolution suspension methods in which a binder resin and coloring agent, releasing agent, and, as the need arises, a solution of a charging controller or the like are suspended in a water-system solvent and granulated.

Further, there are well known methods, which can be employed, such as a manufacturing method in which toner obtained in the above-described methods is employed as a core and in which agglomeration particles are further stuck to the toner to be heated to be fusion-bonded so as to have a core-shell structure. However, the suspension polymerization method, the emulsion polymerization agglomeration method, and the dissolution suspension method in which manufacturing is carried out employing a water-system solvent are preferred from a shape control viewpoint and a particle size distribution control viewpoint, and the emulsion polymerization agglomeration method is particularly preferred. A toner base material is comprised of a binder resin, coloring agent, and releasing agent, and silica and a charging controller may be employed as the need arises.

Toner having a mean particle size of 2-12 μm, preferably a toner base material having a mean particle size of 3-9 μm, may be employed. By employing toner with a mean shape factor (ML2/A) of 115-140, a high developing and transfer performance, and a high quality image can be obtained.

The mean shape coefficient (ML2/A) means a value calculated using the following equation, and in the case of a sphere, ML2/A=100. ML2/A is the (maximum length)$^2\times\pi\times100/$(area×4). As a specific method for finding a mean shape factor, a toner image is read into an image analyzer (Trade name: LUZEX III; manufactured by NIRECO Corporation) from an optical microscope, a diameter corresponding to a circle is measured, and the above-described equation of ML2/A values are found for respective particles from maximum lengths and areas.

Examples of the binder resin used include homopolymers and copolymers made from: styrenes such as styrene, and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, vinyl butyl ether; and vinyl ketones such as vinyl methyl ketone, vinyl hexyl ketone, and vinyl isopropenyl ketone. Particularly typical examples of the binder resin include polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene, and polypropylene.

Other typical examples of the binder resin include polyester, polyurethane, epoxy resin, silicone resin, polyamide, modified rosin, and paraffin wax.

Typical examples of the coloring agent of the toner include magnetic powder made of magnetite, ferrite or the like, carbon black, aniline blue, kalyl blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Typical examples of the releasing agent include low molecular weight polyethylene, low molecular weight polypropylene, Fischer-Tropsch wax, montan wax, carnauba wax, rice wax, and candelilla wax.

If necessary, an charging controller may be added to the toner. Known charging controllers may use, examples of which include azo metal complex compounds, metal complex compounds of salicylic acid, and resin type charging controllers having a polar group.

When the toner is produced through a wet process, it is preferable to use raw materials which do not easily dissolve in water in order to control the ionic strength and decrease pollution with waste water. The toner used in the invention may be a magnetic toner, which includes a magnetic material, or a nonmagnetic toner, which does not include any magnetic material.

The toner used in the invention can be produced by mixing the above-mentioned toner particles and the above-mentioned external additives by means of a Henschel mixer, a V blender, or the like. When the toner particles are wet-produced, the external additives may be externally added thereto in a wet step.

Examples of the lubricant particles added to the toner used in the invention include solid lubricants such as graphite, molybdenum disulfide, talc, aliphatic acids, and aliphatic acid metal salts; low molecular weight polyolefins such as polypropylene, polyethylene, and polybutene; silicones exhibiting a softening point by heating; aliphatic amides such as erucic amide, ricinoleic amide, and stearic amide; plant waxes such as carnauba wax, rice wax, candelilla wax, tallow, and jojoba oil; animal waxes such as beeswax; mineral or petroleum waxes such as montan wax, ozocerite, ceresin, paraffin wax, microcrystalline wax, and Fischer-Tropsch wax; and modified products thereof. These may be used alone or in combination. The substance having any one of the above-mentioned chemical structures may be crushed into particles having an average particle diameter in the range of 0.1 to 10 μm so as to make the particle diameters thereof even. The added amount thereof to the toner is preferably from 0.05 to 2.0% by weight, more preferably from 0.1 to 1.5% by weight.

To the toner used in the invention can be added inorganic particles, organic particles, composite particles wherein inorganic particles are caused to adhere to organic particles in order to remove deposits or deteriorated materials on the surface of an electrophotographic photosensitive body, or attain some other purpose. Inorganic particles excellent in abrasive performance are in particular preferably added thereto.

Preferable examples of the used inorganic particles include particles of various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may be treated with: a titanium coupling agent, such as tetrabutyl titanate, tetraoctyl titanate, isopropyltriisostearoyl titanate, isopropyltridecylbenzenesulfonyl titanate, or bis(dioctylpyrophosphate)oxyacetate titanate; a silane coupling agent, such as γ-(2-aminoethyl) aminopropyltrimethoxysilane, γ-(2-aminoethyl)aminopropylmethyldimethoxysilane, γ-methacryloxypropyltrimethoxysilane,N-β-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane; or the like.

It is also preferable to subject the inorganic particles to hydrophobicity treatment with silicone oil, or a metal salt of a higher fatty acid, such as aluminum stearate, zinc stearate or calcium stearate.

Examples of the organic particles include styrene particles, styrene acrylic resin particles, polyester particles, and urethane particles.

The average particle diameter of the particles is from 5 to 1000 nm, preferably from 5 to 800 nm, more preferably from 5 to 700 nm for the following reasons: if the particle diameter is too small, the polishing performance is insufficient; and if the particle diameter is too large, injures are easily generated in the surface of an electrophotographic photosensitive body. Preferably, the total ratio of the added amount of the particles and the lubricant particles is 0.6% or more by weight of the whole.

As other inorganic oxides to be added to the toner, it is preferable to use a small-diameter inorganic oxide having a primary particle diameter of 40 nm or less, and further add, to the toner, an inorganic oxide having a diameter larger than the diameter of the small-diameter inorganic oxide in order to control the fluidity of the powder or charging.

Known inorganic oxide particles may be used, and a preferably example is a mixture of silica particles and titanium oxide particles for precise charging control. When the small-diameter inorganic particles are subjected to surface-treatment, the dispersibility thereof is improved so that an effect of making the powder fluidity high becomes large.

The electrophotographic color toner is used mixed with a carrier, which may consist of iron powder, glass beads, ferrite powder, nickel powder, or a product wherein any one of these materials is coated with a resin. The blend ratio between the toner and the carrier can be appropriately set.

Here, the process cartridge 120 is composed of a photosensitive drum 116, a charge roller 118 disposed at the circumference of the photosensitive drum 116, an erasing lamp 122, developing devices 10 (10A, 10B, 10C, and 10D) performing developing of toner of respective colors with respect to an electrostatic latent image made on the photosensitive drum 116, and the like.

On the other hand, a paper feeding cassette 124 in which paper P is accommodated is disposed in an lower part of the printer 110. A pick up roller 126 that causes the paper P to be fed at a predetermined timing is provided adjacent to the paper feeding cassette 124.

The paper P fed out from the paper feeding cassette 124 by the pick up roller 126 is fed to a paper transport path 132 via transport rollers 128 and registration rollers 130 to be transported to a transporting device 144 transporting the paper P to the process cartridges 120.

The process cartridges 120 are arranged in above-described Y, M, C, and K order of colors from the upstream side of the paper transport path 132, and an exposure device 134 that emits scanning light to the process cartridges 120 is disposed at the left side of the process cartridges 120 as viewed in the drawing.

The exposure device 134 includes an unillustrated semiconductor laser, a polygon mirror 138, imaging lenses 140, and mirrors 142 inside a case 136, and is structured such that light emitted from the semiconductor laser is polarized and scanned by the polygon mirror 138 and is irradiated onto the photosensitive drum 116 via the imaging lenses 140 and the mirrors 142, so that an electrostatic latent image according to image information is formed on the photosensitive drum 116.

An image data processing unit 166 is disposed at a position adjacent to the exposure device 134, and a control circuit 168 that performs operation control of the exposure device 134, the process cartridges 120, a fixation device 156, and the like is provided below the exposure device 134.

The above-described transporting device 144 is provided at the right side (a position opposing to the image data processing unit 166) of the printer 110, as viewed in the drawing. The transporting device 144 is composed of a pair of tensioning rollers 146, 148 provided along a side wall 110A of the printer 110, and a transport belt 150 that is entrained around these entraining rollers 146, 148. The entraining roller 148 is rotated by an unillustrated motor so that the transport belt 150 moves.

An attracting roller 154 is provided adjacent to the entraining roller 146. A voltage is applied to this attracting roller 154 so that the paper P is electrostatically attracted and attached to the transport belt 150.

Transfer rollers 152 are provided on the back surface side of the transport belt 150 at positions facing the respective colors photosensitive drums 116. By these transfer rollers 152, a toner image on the photosensitive drum 116 is transferred to the paper P transported by the transport belt 150 so as to be fixed by the fixation device 156. The paper P on which the toner image is fixed is discharged to a catch tray 160 by discharge rollers 158.

Next, the developing device 10 according to the first exemplary embodiment of the invention will be described.

The developing device 10 according to the first exemplary embodiment of the invention uses a two-component developing method.

Figure 2A:
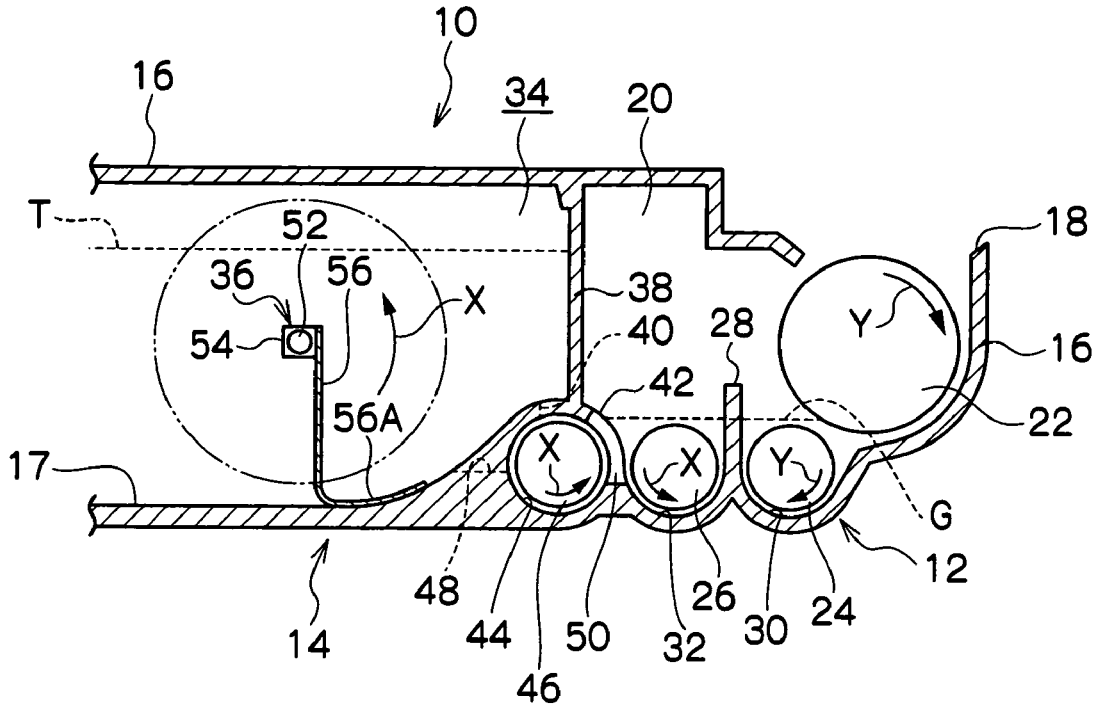
FIGS. 2A-2B are cross-sectional views of a developing device according to a first exemplary embodiment of the invention.
Figure 2B:
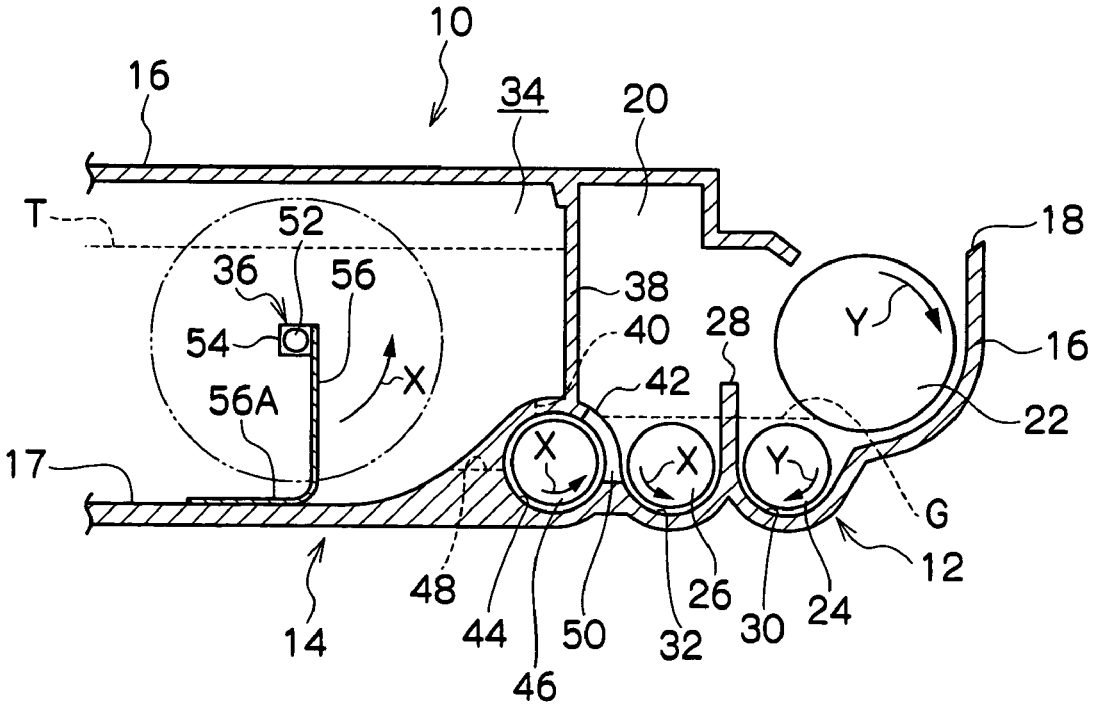

FIGS. 2A-2B show the developing device 10 as a powder supply unit of the invention. FIG. 2A shows a state in which the developing device 10 is in non-use, and FIG. 2B shows a state in which the developing device 10 is in use.

The developing device 10 is structured such that a developing unit 12, which is disposed at a position facing the photosensitive drum 116 (see FIG. 1) and transforms an electrostatic latent image a visible image on the photosensitive drum 116 into a visible image using a developing agent G formed of toner and carrier, and a toner replenishment unit 14 that supplies toner T to this developing unit 12 are laterally unified with each other.

The developing unit 12 has a housing 16 which is a case formed of resin. The housing 16 is provided at the lower side of the photosensitive drum 116, and formed with an opening 18 which is opened toward the photosensitive drum 116 side. The housing 16 has a generally rectangular flat shape in which the length of the bottom wall is longer than that of the side wall.

A developing agent accommodating chamber 20 is formed inside the housing 16, and the developing agent G formed of toner and carrier is accommodated in the developing agent accommodating chamber 20.

A developing roller 22 is provided in the housing 16 such that a part thereof is exposed from the opening 18 of the housing 16. The developing roller 22 is rotatably supported on a peripheral wall of the housing 16. An unillustrated gear is securely attached to an end portion of the developing roller 22, and a rotational force from an unillustrated motor is transmitted to the gear so that the developing roller 22 can be rotated in a Y direction via the gear.

The developing roller 22 magnetically attracts carrier contained in the developing agent G to form a magnetic brush of the developing agent G on its surface so that toner attached to the carrier is transported to a developing area facing the photosensitive medium. The electrostatic latent image formed on the photosensitive medium is transformed into a visible image by the magnetic brush of the developing agent G formed of the carrier and toner which is formed on the surface of the developing roller 22.

A first stirring/transporting auger 24 and a second stirring/transporting auger 26 are disposed in a lower side of the developing roller 22 along the axial direction of the developing roller 22. The first stirring/transporting auger 24 and the second stirring/transporting auger 26 are provided with unillustrated rotating shafts, respectively, and are rotatably supported on a peripheral wall of the housing 16.

A first partition wall 28 is formed between the first stirring/transporting auger 24 and the second stirring/transporting auger 26, and by this first partition wall 28, the inside of the developing agent accommodating chamber 20 is divided into two that are a first stirring path 30 on which the first stirring/transporting auger 24 is arranged and a second stirring path 32 on which the second stirring/transporting auger 26 is arranged.

On both end portions of the first partition wall 28 in the longitudinal direction thereof unillustrated communicating holes are formed, and by these communicating holes, the first stirring path 30 and the second stirring path 32 are communicated with each other. Thus, the developing agent G in the developing agent accommodating chamber 20 is transported while being stirred in the first stirring path 30 and the second stirring path 32 by the rotations of the first stirring/transporting auger 24 and the second stirring/transporting auger 26, respectively, so that the developing agent G circulates between the first stirring path 30 and the second stirring path 32.

On the other hand, a toner accommodating chamber 34 in which toner T is accommodated is provided in the toner replenishment unit 14 adjacent to the developing unit 12. A first agitator 36 is disposed along the axial direction of the developing roller 22 in the toner accommodating chamber 34.

A second partition wall 38 as a side wall of the toner accommodating chamber, a curved wall 40, and a third partition wall 42 are provided between the toner accommodating chamber 34 and the developing agent accommodating chamber 20.

The curved wall 40 extends from an under side of the second partition wall 38 to the toner accommodating chamber 34 side, and the third partition wall 42 extends to the developing agent accommodating chamber 20 side, so that a tunnel-shaped dispensing chamber 44 is formed on the bottom part of the housing 16. A dispensing auger 46 stirring and transporting toner along the longitudinal direction is disposed in the dispensing chamber 44.

A toner supplying hole 48 is formed in an lower side of the second partition wall 38 in the vicinity of one end portion of the curved wall 40 in the longitudinal direction thereof such that the toner accommodating chamber 34 and the dispensing chamber 44 are communicated with each other. Thus, the toner T accommodated in the toner accommodating chamber 34 is transported in the toner accommodating chamber 34 in the axial direction while being stirred by the first agitator 36 so as to be fed from the toner supplying hole 48 into the dispensing chamber 44.

On the other hand, an aperture 50 is formed in the vicinity of the other end portion of the third partition wall 42 in the longitudinal direction thereof such that the dispensing chamber 44 and the developing agent accommodating chamber 20 are communicated with each other. Thus, the toner T in the dispensing chamber 44 is transported in the dispensing chamber 44 while being stirred by the dispensing auger 46 so as to be fed from the aperture 50 into the developing agent accommodating chamber 20.

The aperture 50 is formed such that the bottom end portion thereof is positioned below the surface position of the developing agent G accommodated in the developing agent accommodating chamber 20. Thus, at least part of the aperture 50 is buried in the developing agent G accommodated in the developing agent accommodating chamber 20 so that the toner T fed from the dispensing chamber 44 into the developing agent accommodating chamber 20 is easily mixed in with the developing agent G accommodated in the developing agent accommodating chamber 20.

The first agitator 36 is provided with a cylindrical first rotating shaft 52, a rectangular parallelepiped first rotating member 54, and a first stirring/transporting film 56, and is rotatably supported on a peripheral wall of the toner replenishment unit 14.

The first stirring/transporting film 56 made of a flexible resin film such as PET and the like is attached and fixed by gluing to the first rotating member 54 of the first agitator 36 in the axial direction thereof.

Here, since the toner supplying hole 48 is arranged in a side wall that is the second partition wall 38 as described above, the first agitator 36 and another unillustrated agitator are arranged in a line in the horizontal direction toward the toner supplying hole 48.

As shown in FIG. 2A, a distal end portion 56A (free end side) of the first stirring/transporting film 56 is bent in a direction opposite to a bending direction (see FIG. 2B) of the distal end portion 56A of the first agitator 36 of the developing device 10 using time, and is in contact with an inner wall of the housing 16 to be supported thereby.

Regarding the support of the distal end portion 56A, it may be supported in a state of FIG. 2A before the toner T is filled during manufacturing of the developing device 10, or the first agitator 36 may be rotated within one rotation in the direction opposite to that of the using time (opposite direction of an arrow X) after toner is filled in the developing device 10 so that the distal end portion 56A can be supported in the direction opposite to that of the using time.

An unillustrated toner filling hole is provided in the side wall supporting first rotating shaft 52 in the housing 16, and the toner filling hole is sealed by an unillustrated rubber cap except the time of filling the toner T.

A the time of filling of the toner T, the developing device 10 is stood up in the vertical direction, the rubber cap is removed, and the toner T is poured in through the toner filling hole.

After the toner T is filled, the developing device 10 is arranged in the horizontal direction for use.

Figure 3A:
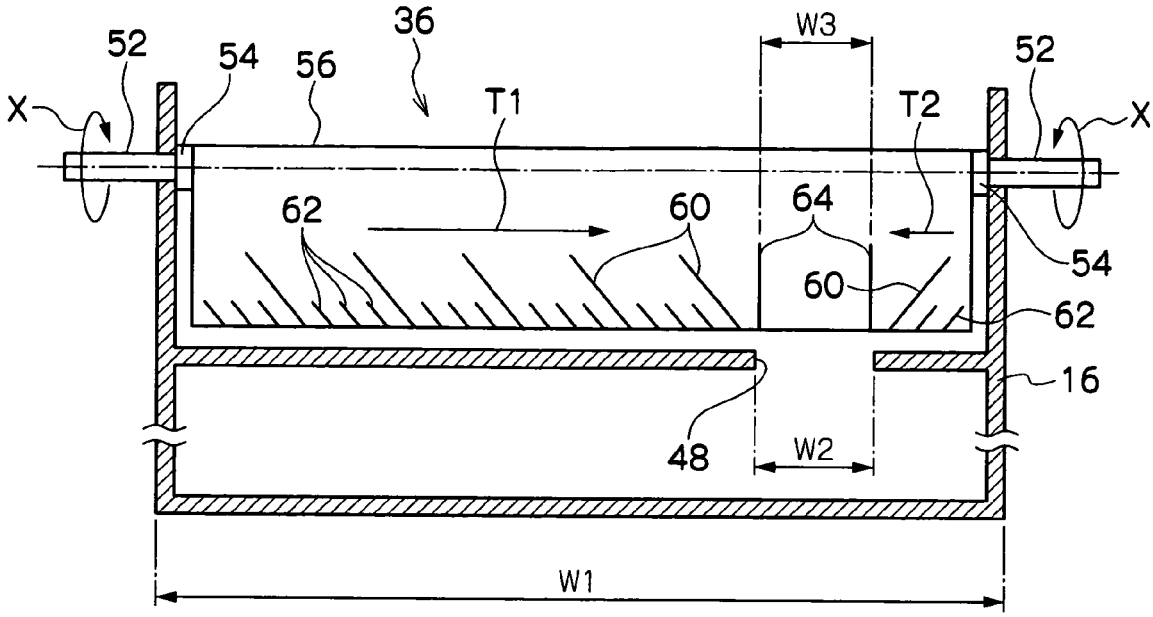
FIGS. 3A-3B are cross-sectional views of a housing and an agitator according to the first exemplary embodiment of the invention.

Here, as shown in FIG. 3A, first slits 60, second slits 62, and third slits 64 are formed in the first stirring/transporting film 56.

The first slits 60 and the second slits 62 are angled about 45° relative to the axial direction of the first rotating member 54, and plural thereof are arranged in directions which are directed from both end portions down toward the toner supplying hole 48. The length of the first slits 60 is longer than that of the second slits 62. In the present embodiment, three second slits 62 are arranged between a pair of first slits 60.

A pair of third slits 64 are provided at positions facing the toner supplying hole 48 having length W2 in the width direction and are spaced at length W3 in the width direction. The direction of slitting of the third slit 64 corresponds to the turning radial direction of the first rotating member 54.

The length in the axial direction of the first rotating shaft 52 in the housing 16 is W1. Here, W3 has a length of one half of W2 or longer, and W2 has a length of one half of W1 or shorter.

In the present example embodiment, the lengths in the width direction is set such that W1>W2>W3.

As shown in FIGS. 2A-2B, an unillustrated gear is fixed on an end portion of the first rotating shaft 52, and a rotational force from an unillustrated motor is transmitted to the gear. When the first rotating member 54 rotates via the gear, the first stirring/transporting film 56 rotates, and the toner T in the toner accommodating chamber 34 is supplied to the toner supplying hole 48 while being stirred and transported.

Here, the above described lengths W1, W2 will be explained.

Table 1 shows results obtained by evaluating transportation non-uniformity of the toner T when an aperture width W2 of the toner supplying hole 48 is changed with respect to the length W1 of the housing in FIG. 3A. Determination of the rank of transportation non-uniformity of the toner T are by variations of the amount of toner supplied to the aperture 50 through the toner supplying hole 48 within a predetermined time and transportation conditions determined by the naked eye.

TABLE 1

| Aperture width (W2)/ housing length (W1) | Toner transportation non-uniformity |
|---|---|
| 0.1 | A |
| 0.2 | A |

TABLE 1-continued

| Aperture width (W2)/ housing length (W1) | Toner transportation non-uniformity |
|---|---|
| 0.3 | A |
| 0.4 | A |
| 0.5 | B |
| 0.6 | C |
| 0.7 | D |
| 0.8 | D |
| 0.9 | D |
| 1.0 | D |

A: Non-uniformity is rare
B: Some non-uniformity exists
C: Quite Large Non-uniformity
D: Large Non-uniformity As shown in Table 1, it can be seen that when the ratio of the aperture width W2 of the toner supplying hole 48 with respect to the length W1 of the housing 16 becomes 0.6 or larger, the transportation non-uniformity of the toner T becomes large.

When the transportation non-uniformity of the toner T is large, the fluctuation of discharge amounts of the toner T discharged to the developing agent accommodating chamber 20 becomes large, so that non-uniformity of image density at the time of image formation becomes large.

Further, when the aperture width W2 is wide, toner which is once introduced into the toner supplying hole is easily forced out again to the toner accommodating chamber 34 side during the transportation in the toner supplying hole.

Accordingly, the ratio of the aperture width W2 of the toner supplying hole 48 with respect to the length W1 of the housing 16 is preferred to be 0.5 or less.

However, when the width of the toner supplying hole 48 is extremely narrow, since the entire amount of supply of the toner T itself will be decreased, the minimum aperture width W2 is preferred to be 10 mm.

Regarding the first agitator 36, a form other than that in which the first stirring/transporting film 56 is glued to the first rotating member 54 may be employed.

Figure 4A:
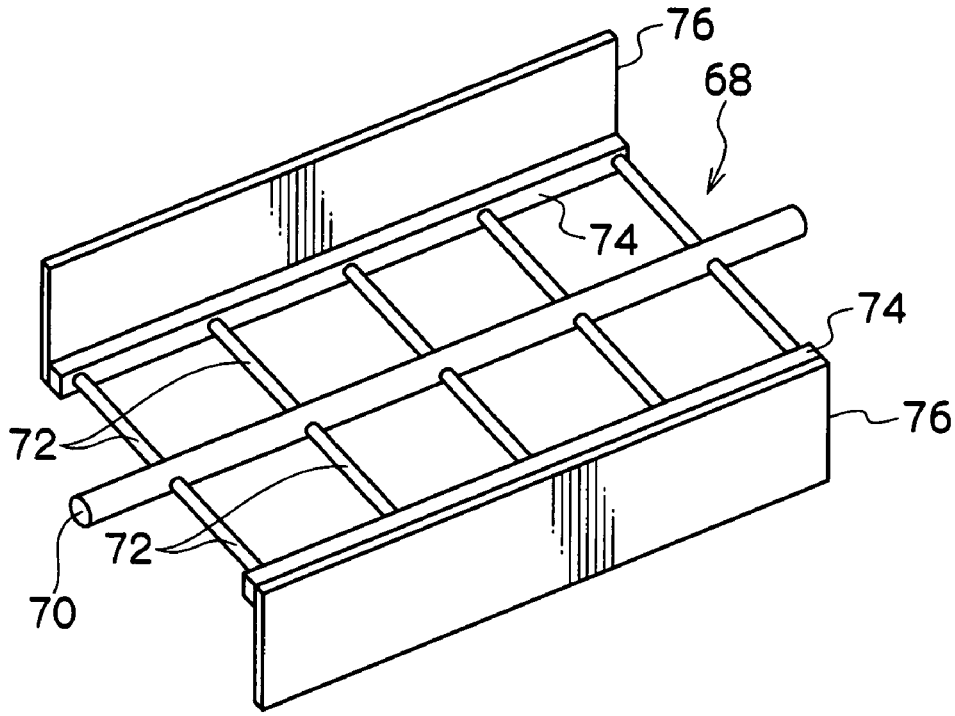
FIGS. 4A-4B are perspective views of the agitator according to the first exemplary embodiment of the invention.

FIG. 4A shows an agitator 68 as a second example of the agitator. The agitator 68 is composed of a cylindrical rotating shaft 70, a plurality of supporting rods 72 formed to project in symmetrical directions (both sides) in which the rotating shaft 70 is centered and which are perpendicular to the rotating shaft 70, supporting plates 74 arranged on one end portions of the supporting rods which are in the sides opposite to the rotating shaft 70, transportation films 76 whose one ends are fixed to the supporting plates 74 and which have free ends.

Figure 4B:
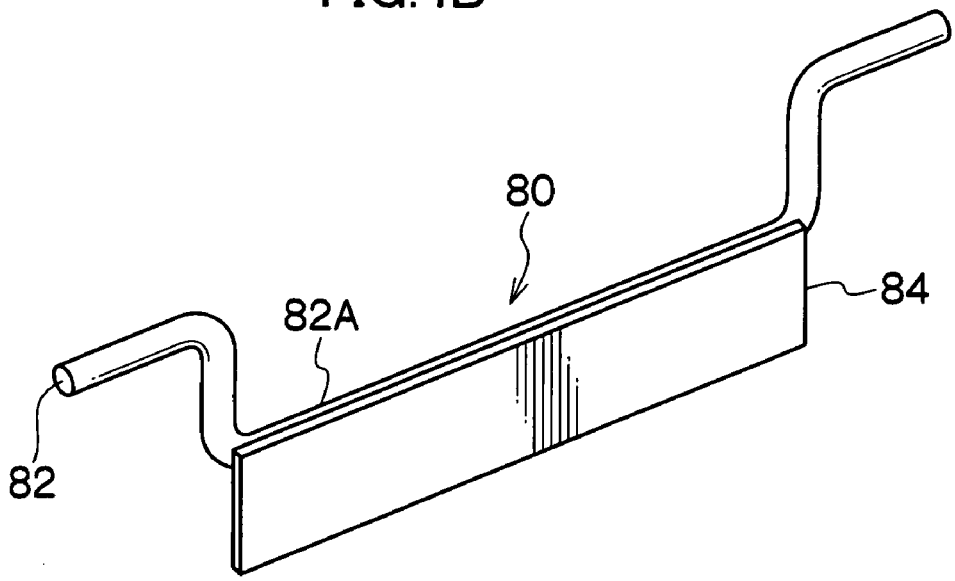

An agitator 80 as a third example of the agitator is shown in FIG. 4B. The agitator 80 is comprised of a cylindrical rotating shaft 82, whose one part is bent to be U-shaped, a flat portion 82A formed on the rotating shaft 82, and a transportation film 84, whose one end is fixed on the flat portion 82A and which has a free end.

The transportation films 76, 84 can be held in the direction opposite to the bending direction of when the developing device 10 is in use (see FIGS. 2A-2B) also for the agitators of the second and third examples.

Next, the operation of the first exemplary embodiment of the invention will be explained.

As shown in FIG. 2A, when the developing device 10 is not in use, the distal end portion 56A of the first stirring/transporting film 56 is bent to be held in the direction opposite to the direction of when in use.

The unillustrated motor is driven, and the first agitator 36 rotates in the direction X so that the state of holding the distal end portion 56A in the vicinity of the second partition wall 38, particularly at the corner portion formed by the second partition wall 38 and the inner wall of the housing 16, is released. The first stirring/transporting film 56 becomes substantially flat.

Further, when the first stirring/transporting film 56 is rotated in the X direction so that at this time a load by the toner T is applied to the film, it is bent in the direction opposite to the X direction to be in a bending state that is the same as the state of when in use as shown in FIG. 2B.

Since when the developing device 10 is not used the distal end portion 56A is bent in the direction opposite to that when in use, a tendency of bending in the bending direction of when in use is not made, so that the toner transport force of the first stirring/transporting film 56 is not deteriorated after the use of the developing device 10 is started, thereby performing stable toner transportation.

Figure 3B:
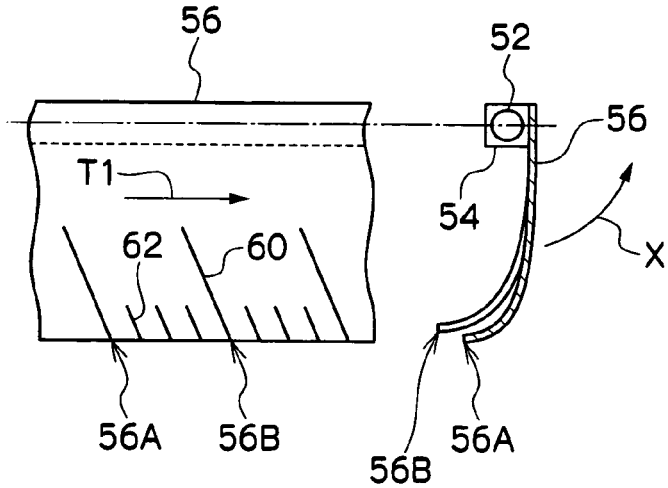

Here, as shown in FIG. 3B, since differences in bending ways in the first stirring/transporting film 56 occurs among the plural first slits 56A, 56B, toner transportabilities (T1, T2) to the axial direction are generated. Similarly, among the second slits 62 also, toner transportabilities T1, T2 to the axial direction are generated.

Hereafter, by the rotational force and an elasticity restoring force of the first stirring film 56, the toner T in the toner accommodating chamber 34 is stirred and transported to be supplied to the toner supplying hole 48.

The toner T supplied from the toner supplying hole 48 to the developing agent accommodating chamber 20 is mixed with the developing agent G to be supplied to the developing roller 126.

As described above, in the first exemplary embodiment of the invention, since the distal end portion 56A of the first stirring/transporting film 56 is in a state when not in use, at the time of transportation and during holding, in which it is bent in the direction opposite to the bending direction of when the developing device 10 is in use, a tendency to bend in the bending direction of the using time is not made in the distal end portion 56A of the first stirring/transporting film 56, so that the elasticity restoring force can be maintained.

Thus, the toner transport force after the use of the developing device 10 is started becomes stable, and a sufficient amount of toner can be transported to the toner supplying hole 48, so that stable image densities can be obtained at the time of image formation.

Since toner introduced via the toner supplying hole 48 is not forced out into the toner accommodating chamber 34 again during the transportation since the aperture width W2 of the toner supplying hole 48 has a length of one half of the length W1 of the housing 16 or less, the toner transport force of the first stirring/transporting film 56 can be prevented from decreasing, and toner transportation non-uniformity downstream of the toner supplying hole 48 can be suppressed.

Further, toner is transported and supplied in the horizontal direction toward the toner supplying hole 48 formed in a lower portion of the second partition wall 38 that is a side wall of the housing 16. In the case where a plurality of agitators are provided, since the agitators are arranged in a line in the horizontal direction, the thickness of the housing in the vertical direction can be prevented from increasing, so that it can be miniaturized and made flat with a large capacitance.

Next, a second exemplary embodiment of the powder supply unit of the invention will be described with reference to the drawings.

The same reference numerals as those of the above-described first exemplary embodiment will be assigned to the parts that are fundamentally the same as those of the first exemplary embodiment, and description thereof will be omitted.

Figure 5A:
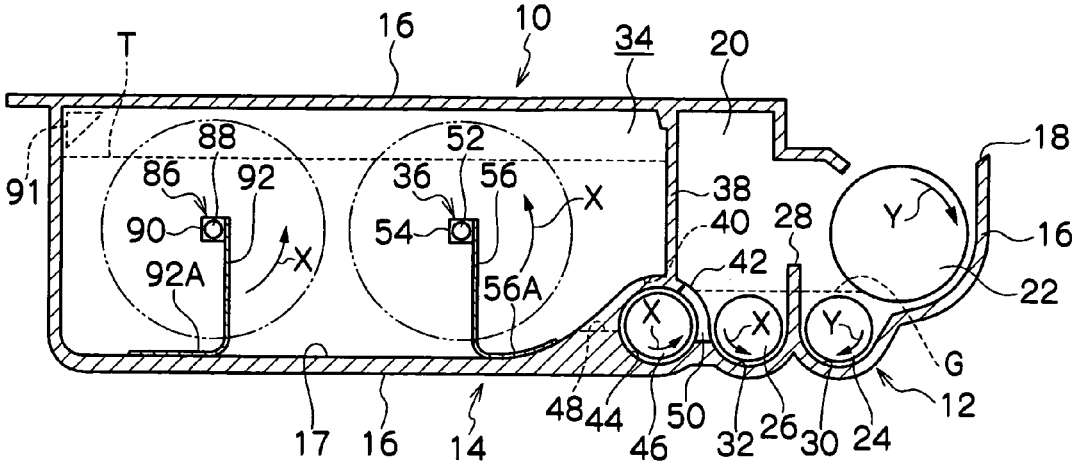
FIGS. 5A-5C are cross-sectional views of a developing device according to a second exemplary embodiment of the invention.
Figure 5B:
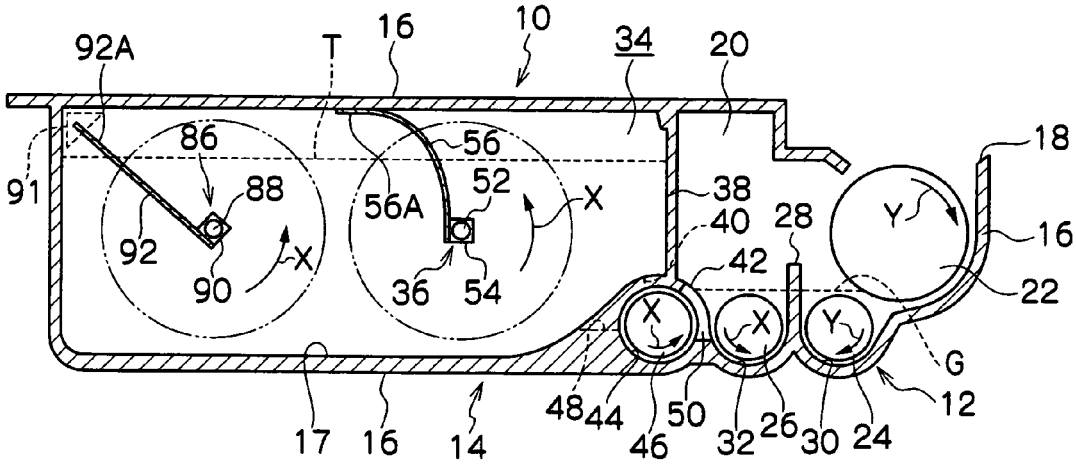
Figure 5C:
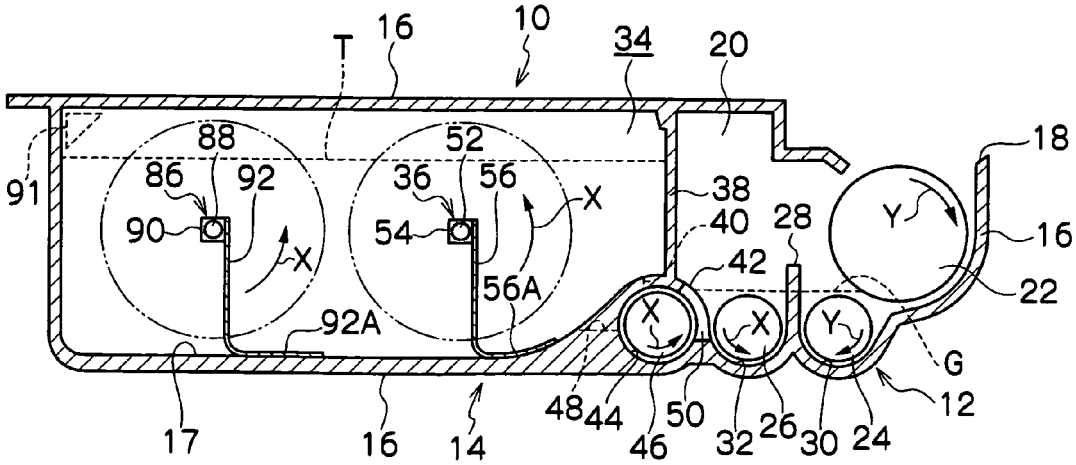

FIGS. 5A, 5B, and 5C are cross-sectional views showing the entire developing device 10 described in the first exemplary embodiment, and another second agitator 86 is provided in the toner accommodating chamber 34 in addition to the first agitator.

The second agitator 86 is provided with a cylindrical second rotating shaft 88, a rectangular parallelepiped second rotating member 90, and a second stirring/transporting film 92, and is rotatably supported on a peripheral wall of the toner replenishment unit 14. The second stirring/transporting film 92 made of a flexible resinous film such as PET and the like is attached and fixed by gluing to the second rotating member 90 in the axial direction thereof.

Here, in a case where a sheet-like transporting member provided adjacent to the toner supplying hole 48 is a front transporting member and where a sheet-like transporting member provided adjacent to the side wall positioned in the opposite side of the second partition wall 38 that is the side wall in which the toner supplying hole 48 is provided is a rear transporting member, the first stirring/transporting film 56 is the front transporting member, and the second stirring/transporting film 92 is the rear transporting member.

In FIGS. 5A, 5B, and 5C, the distal end portion 56A (free end side) of the first stirring/transporting film 56 is bent in the same direction as the rotational direction X of the first agitator 36 and is in contact with the inner wall of the housing 16 to be supported thereby.

In FIG. 5A, a distal end portion 92A (free end side) of the second stirring/transporting film 92 is bent in the direction opposite to the rotational direction X of the second agitator 86 and is in contact with a bottom wall of an inner wall 17 of the housing 16 to be supported thereby.

In FIG. 5B, provided is an escape area 91 which is surrounded by an upper surface and a side surface of the inner wall and in which the distal end portion 92A is not in contact with the inner wall 17 or is in contact with it without bending, and the distal end portion 92A of the second stirring/transporting film 92 is supported so as to be positioned in the escape area 91. At this time, the direction of a portion fixed on the second rotating member 90 of the stirring/transporting film 92 is an oblique direction (a direction from a right bottom to a left top), and is different from that perpendicular to the bottom wall or ceiling wall of the housing 16 having a substantially rectangular shape.

Further, in FIG. 5C, the distal end portion 92A of the second stirring/transporting film 92 is bent in the same direction as the rotational direction X of the second agitator 86 and is in contact with a bottom surface side of the inner wall of the housing 16 so as to be supported thereby.

A state in which plural rotating members rotate while maintaining a predetermined rotational positional relationship corresponds to a rotational state of the same phase, and in any of FIGS. 5A, 5B, and 5C, the first rotating member 54 and the second rotating member 90 rotate at the same phase.

Next, the operation of the second exemplary embodiment of the invention will be explained.

In FIG. 5A, when the developing device 10 is not in use, the distal end portion 56A of the first stirring/transporting film 56 is bent to be held in the same direction as the rotational direction, and the distal end portion 92A of the second stirring/transporting film 92 is bent to be held in the direction opposite to the rotational direction Here, an unillustrated motor is driven, and the first agitator 36 and the second agitator 86 rotate in the X direction so that the hold state of the distal end portion 56A in the vicinity of the second partition wall 38, particularly on an edge portion formed by the second partition wall 38 and the inner wall of the housing 16, is released. Thus, the first stirring/transporting film 56 becomes substantially flat.

At this time, the bending state of the second stirring/transporting film 92 is not changed.

Further, when the first stirring/transporting film 56 is rotated in the X direction, it is bent this time in the direction opposite to the X direction due to the load of the toner T.

At this time, the bending state of the second stirring/transporting film 92 is not changed.

The first agitator 36 and the second agitator 86 rotate one rotation or more in the X direction, so that both the first stirring/transporting film 56 and second stirring/transporting film 92 are in a state in which both are bent in the direction opposite to the rotational direction X. Hereafter, by the rotation in the X direction, the toner T is supplied to the toner supplying hole 48.

Here, due to the state in which the distal end portion 56A is bent in the direction opposite to that of when in use, since a tendency of bending in the bending direction of use is not made, the toner transport force of the first stirring/transporting film 56 is not deteriorated after the use of the developing device 10 is started, so that toner can be stably transported.

On the other hand, the second stirring/transporting film 92 stirs and transports toner to the first agitator 36 side without giving a strong load to the toner.

In FIG. 5B, when the developing device 10 is not used, the distal end portion 56A of the first stirring/transporting film 56 is bent and held in the same direction as the rotational direction, and the distal end portion 92A of the second stirring/transporting film 92 is held in the escape area 91.

Here, when the unillustrated motor is driven so that the first agitator 36 and the second agitator 86 rotate in the X direction, the hold state of the distal end portion 56A is released, in the vicinity of an upper surface central portion of the inner wall, at a position above the upper surface of the first rotating member 54, and the first stirring/transporting film 56 becomes roughly flat.

At this time, the distal end portion 92A of the second stirring/transporting film 92 is in contact with the inner wall 17 and is bent in the direction opposite to the rotational direction X.

Further, when they are rotated in the X direction, this time due to the load of the toner T, the first stirring/transporting film 56 is bent in the direction opposite to the X direction.

At this time, the bending state of the second stirring/transporting film 92 is not changed.

Thus, the first agitator 36 and the second agitator 86 rotate one rotation or more in the X direction, so that both the first stirring/transporting film 56 and second stirring/transporting film 92 are in a state in which both are bent in the direction opposite to the rotational direction X. Hereafter, by the rotation in the X direction, the toner T is supplied to the toner supplying hole 48.

Here, in the first stirring/transporting film 56, due to the state in which the distal end portion 56A is bent in the direction opposite to that of when in use, since a tendency of bending in the bending direction of when in use is not made, the toner transport force is not deteriorated from when the use of the developing device 10 is started, so that toner can be stably transported.

On the other hand, in the second stirring/transporting film 92, since the distal end portion 92A is positioned in the escape area 91 so that the free end is not held in a state in which it is in contact with, and perpendicular to, the bottom wall or ceiling wall, a strong bending tendency, for example, such as a substantially L-like shape, is not easy to be made, and a bending tendency in the bending direction of use is not made. Thus, the toner transport force is not deteriorated after the use of the developing device 10 is started, stable toner transportation is carried out.

In FIG. 5C, when the developing device 10 is not used, the distal end portion 56A of the first stirring/transporting film 56 is bent and held in the same direction as the rotational direction, and the distal end portion 92A of the second stirring/transporting film 92 is bent and held in the direction opposite to the rotational direction.

Here, when the unillustrated motor is driven so that the first agitator 36 and the second agitator 86 rotate in the X direction, in the first stirring/transporting film 56, the hold state of the distal end portion 56A is released, in the vicinity of the second partition wall 38, at an edge portion formed by the second partition wall 38 and the inner wall of the housing 16.

In the second stirring/transporting film 92, when the distal end portion 92A becomes in a state not in contact with the inner wall 17, the hold state of the distal end portion 92A is released.

Further, the first stirring/transporting film 56 and the second stirring/transporting film 92, when rotating in the X direction, come in contact with the upper surface of the inner wall 17 to be bent in the direction opposite to the X direction.

Thus, the first agitator 36 and the second agitator 86 rotate one rotation or more in the X direction, so that both the first stirring/transporting film 56 and second stirring/transporting film 92 are in a state in which both are bent in the direction opposite to the rotational direction X. Hereafter, by the rotation in the X direction, the toner T is supplied to the toner supplying hole 48.

Since the distal end portion 56A and the distal end portion 92A are bent in the direction opposite to that of use so that the bending tendency in the bending direction of use is not made, after the use of the developing device 10 is started, the toner transport force of the first stirring/transporting film 56 and second stirring/transporting film 92 is not deteriorated, and stable toner transportation is carried out.

As a manufacturing method of the developing device 10, in a case where the first stirring/transporting film 56 and second stirring/transporting film 92 are held at positions shown in FIGS. 5A, 5B, and 5C, and where a process in which toner is filled through an unillustrated toner filling hole is provided, since the first stirring/transporting film 56 and second stirring/transporting film 92 are held, for example, even if a small, flat developing device 10 is employed, toner can be filled without blocking the toner filling hole.

As a recycling method of the developing device 10, in a case where a process in which toner is filled after the first stirring/transporting film 56 and second stirring/transporting film 92 are bent in the direction opposite to the bending direction of when in use is provided, a bending tendency in the bending direction of when the respective stirring/transporting films are used is resolved, and even when they are not interchanged with brand-new stirring/transporting films, stirring and transporting toner is stable from the first stage of using.

As described above, in the second exemplary embodiment of the invention, since the plural rotating members 54, 90 and the plural sheet-like transporting members 56, 92 are provided in the housing 16, even when the housing 16 is flat-shaped, toner transportation to the toner supplying hole 48 is stable.

Further, since phases of the plural sheet-like transporting members 56, 92 are matched, the toner transport force is constant.

Moreover, in the structure of FIG. 5A, since the distal end portion 56A of the first stirring/transporting film 56 is bent to be held in the same direction as the rotational direction X of the first rotating member 54, a tendency to bend in the same bending direction as that when the developing device 10 is used is not easily imparted to the first stirring/transporting film 56, and the elasticity restoring force can be maintained, so that the toner transport force of the first stirring/transporting film 56 can be stable after a use starting time.

On the other hand, since the second stirring/transporting film is bent in the direction opposite to the rotational direction X of the second rotating member 90 so that a bending tendency that is the same as that of the using time is made, an unnecessary load is not imparted to the toner.

In the structure of FIG. 5B, since the distal end portion 56A of the first stirring/transporting film 56 is bent in the same direction as the rotational direction X of the first rotating member 54, a tendency of bending in the same bending direction as that of the developing device 10 using time is hard to be made on the first stirring/transporting film 56, and the elasticity restoring force can be maintained, so that the toner transport force of the first stirring/transporting film 56 can be stable from start of use.

By allowing the second stirring/transporting film 92 to be positioned in the escape area 91, since a tendency to bend in the same bending direction as that of the developing device 10 using time is not easily imparted to the second stirring/transporting film, the elasticity restoring force can be maintained, and the toner transport force of the second stirring/transporting film can be stable from start of use, whereby the amount of remaining toner in the housing 16 can be reduced.

In the structure of FIG. 5C, since the first stirring/transporting film 56 and the second stirring/transporting film 92 are bent in the same direction as the rotational direction X, the tendency to bend in the same bending direction as that of the developing device 10 when used is not imparted, so that the elasticity restoring force can be maintained, and that the toner transport force can be stable from start of use.

Further, since the tendency to bend in the same bending direction as that of using is not imparted to the second stirring/transporting film, for example, even when a flat housing 16 is employed, the toner transport force can be stable, so that remaining toner can be reduced to use toner efficiently.

Moreover, the above-described hold states can be easily set by rotating the respective rotating members (54, 90) in the direction opposite to that of the using time after toner is filled, so that it is easily applicable to the manufacturing process of the developing device 10.

In the above-described manufacturing method, since filling of toner becomes efficient even in a small, flat developing device 10, the productiveness of the developing device 10 is improved. Further, since the tendency to bend of the respective stirring/transporting films can be reduced at the time of transportation and of preservation, stable toner transportation can be realized.

Furthermore, in the above-described recycling method, although the respective stirring/transporting films before recycling are bent due to the weight of toner so that the toner transport force is deteriorated, by allowing the free end sides of the respective stirring/transporting films to bend in the direction opposite to the bending direction of the using time, since set in bending can be corrected and regenerated, a toner transport force substantially equal to that of a brand-new one can be obtained.

As a result, even in the recycled developing device, a toner transport force substantially equal to that of a brand-new one and stable image densities can be obtained.

Next, a third exemplary embodiment of the powder supply unit of the invention will be described with reference to the drawings.

The same reference numerals as those of the above-described first exemplary embodiment will be assigned to the basically same parts as those of the first exemplary embodiment, and description thereof will be omitted.

Figure 6A:
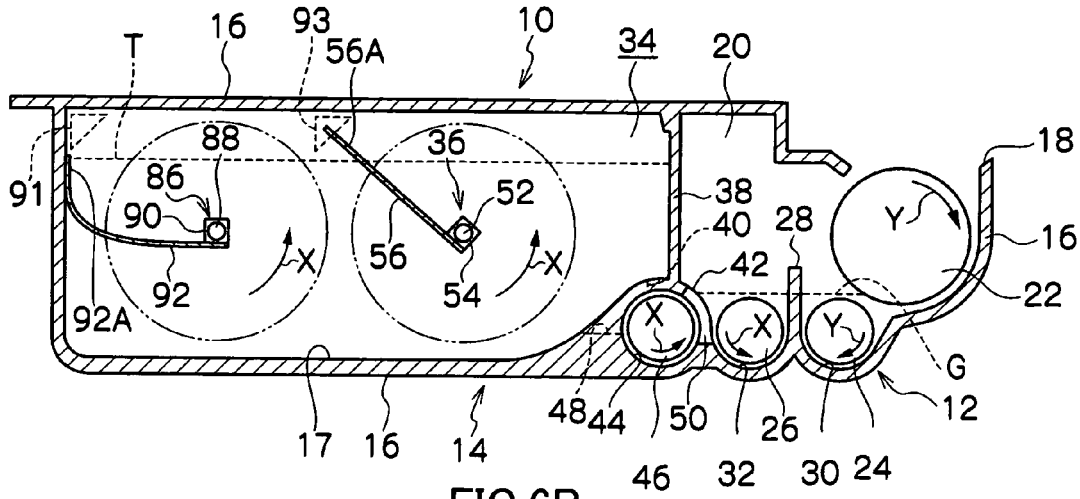
FIGS. 6A-6C are cross-sectional views of a developing device according to a third exemplary embodiment of the invention.
Figure 6B:
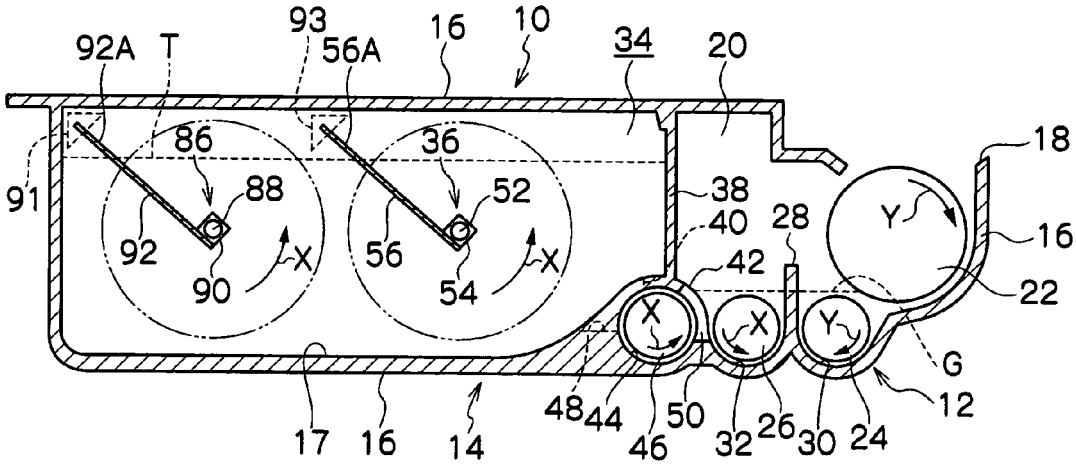
Figure 6C:
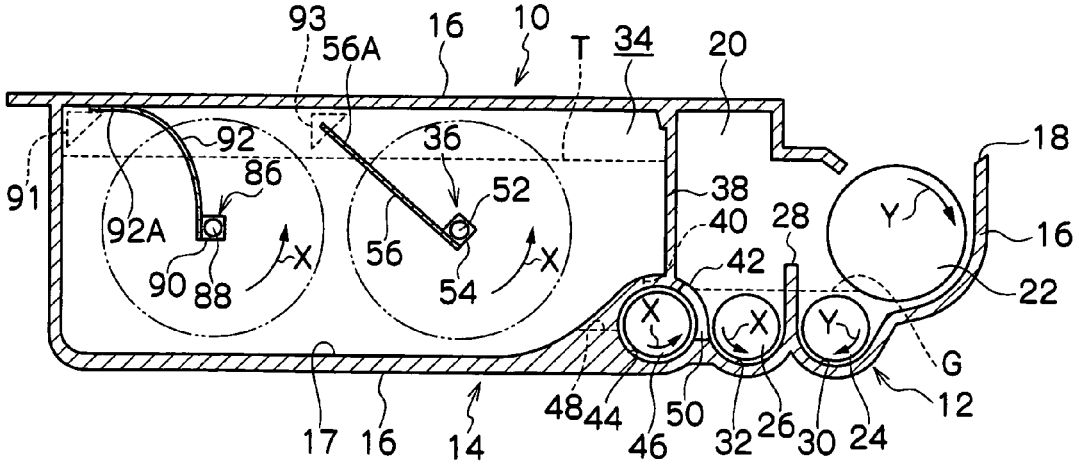

FIGS. 6A, 6B, and 6C show a developing device 10 in which bending states of the first stirring/transporting film 56 and the second stirring/transporting film 92 are changed.

Here, as described above, the first stirring/transporting film 56 is the front transporting member, and the second stirring/transporting film 92 is the rear transporting member.

In the developing device 10 of FIGS. 6A, 6B, and 6C, provided is an escape area 93 which is located in the vicinity of an upper surface central portion of the inner wall 17 and which is located in an upper side with respect to the upper surface of the first rotating member 54, and in which the distal end portion 56A of the first stirring/transporting film 56 is not in contact with the inner wall 17 or is in contact therewith without bending, and the distal end portion 56A of the first stirring/transporting film 56 is held so as to be positioned in the escape area 93.

On the other hand, in FIG. 6A, the distal end portion 92A (free end side) of the second stirring/transporting film 92 is bent in the direction opposite to the rotational direction X of the second agitator 86 and is in contact with a side wall of the inner wall 17 of the housing 16 to be supported thereby.

In FIG. 6B, the distal end portion 92A of the second stirring/transporting film 92 is held so as to be positioned in the escape area 93.

Further, In FIG. 6C, the distal end portion 92A of the second stirring/transporting film 92 is bent in the same direction as the rotational direction X of the second agitator 86 and is in contact with a ceiling surface side of the inner wall 17 of the housing 16 to be supported thereby.

In any of FIGS. 6A, 6B, and 6C, the first rotating member 54 and the second rotating member 90 rotate at the same phase.

Next, the operation of the third exemplary embodiment of the invention will be explained.

In FIG. 6A, when the developing device 10 is not used, the distal end portion 56A of the first stirring/transporting film 56 is held in the escape area 93, and the distal end portion 92A of the second stirring/transporting film 92 is bent and held in the direction opposite to the rotational direction X.

Here, when the unillustrated motor is driven so that the first agitator 36 and the second agitator 86 rotate in the X direction, the distal end portion 56A of the first stirring/transporting film 56 comes in contact with the bottom wall of the inner wall 17 to bend in the direction opposite to the rotational direction X.

On the other hand, the distal end portion 92A of the second stirring/transporting film 92 rotates while bending in the direction opposite to the rotational direction X.

Thus, the first agitator 36 and the second agitator 86 rotate one rotation or more in the X direction so that both the first stirring/transporting film 56 and second stirring/transporting film 92 are in a state in which both bend in the direction opposite to the rotational direction X. Hereafter, by the rotation in the X direction, the toner T is supplied to the toner supplying hole 48.

Here, in the first stirring/transporting film 56, since the distal end portion 56A is positioned in the escape area 93 so that the tendency to bend in the bending direction of the using time is not made, the toner transport force is not deteriorated after the use of the developing device 10 is started, whereby stable toner transportation is carried out.

Meanwhile, the second stirring/transporting film 92 stirs and transports toner to the first agitator 36 side without imparting a strong load to the toner.

In FIG. 6B, when the developing device 10 is not used, the distal end portion 56A of the first stirring/transporting film 56 is held in the escape area 93, and the distal end portion 92A of the second stirring/transporting film 92 is held so as to be positioned in the escape area 91.

Here, when the unillustrated motor is driven so that the first agitator 36 and the second agitator 86 rotate in the X direction, the distal end portion 56A of the first stirring/transporting film 56 and the distal end portion 92A of the second stirring/transporting film 92 comes in contact with the bottom wall or a side wall of the inner wall 17 to be bent in the direction opposite to the rotational direction X.

Thus, the first agitator 36 and the second agitator 86 rotate one rotation or more in the X direction so that both the first stirring/transporting film 56 and second stirring/transporting film 92 are in the state in which both bend in the direction opposite to the rotational direction X. Hereafter, by the rotation in the X direction, the toner T is supplied to the toner supplying hole 48.

Here, in the first stirring/transporting film 56 and the second stirring/transporting film 92, since the distal end portions 56A, 92A are positioned in the escape areas 93, 91 so that the tendency to bend in the bending direction of the using time is not made, the toner transport force is not deteriorated after the use of the developing device 10 is started, whereby stable toner transportation is carried out.

In FIG. 6C, when the developing device 10 is not used, the distal end portion 56A of the first stirring/transporting film 56 is held in the escape area 93, and the distal end portion 92A of the second stirring/transporting film 92 is bent and held in the same direction as the rotational direction X.

Here, when the unillustrated motor is driven so that the first agitator 36 and the second agitator 86 rotate in the X direction, the distal end portion 56A of the first stirring/transporting film 56 comes in contact with the bottom wall of the inner wall 17 to be bent in the direction opposite to the rotational direction X.

Meanwhile, in the second stirring/transporting film 92, when the distal end portion 92A approaches the escape area 91, the hold state of the distal end portion 92A is released, and the distal end portion 92A comes in contact with the upper surface of the inner wall 17 by the rotation to be bent in the direction opposite to the rotational direction.

Thus, the first agitator 36 and the second agitator 86 rotate one rotation or more in the X direction so that both the first stirring/transporting film 56 and second stirring/transporting film 92 are in the state in which both bend in the direction opposite to the rotational direction X. Hereafter, by the rotation in the X direction, the toner T is supplied to the toner supplying hole 48.

Here, in the first stirring/transporting film 56, since the distal end portion 56A is positioned in the escape area 93 so that the tendency to bend in the bending direction of the using time is not made, the toner transport force is not deteriorated after the use of the developing device 10 is started, whereby stable toner transportation is carried out.

Meanwhile, since the second stirring/transporting film 92 is bent in the direction opposite to that of the using time so that the bending tendency in the bending direction of the using time is not made, the toner transport force is not deteriorated after the use of the developing device 10 is started, whereby stable toner transportation is carried out.

As described above, in the third exemplary embodiment of the invention, since the phases of the plural sheet-like transporting members (56, 92) are matched, the toner transport force is constant.

Moreover, in the structure of FIG. 6A, since the distal end portion 56A of the first stirring/transporting film 56 is positioned in the escape area 93 which is provided in an upper side with respect to the upper surface of the first rotating member 54, the tendency to bend in the same bending direction as that of the developing device 10 when used is not easily introduced to the first stirring/transporting film 56, and the elastic restoring force can be maintained, so that the toner transport force of the first stirring/transporting film 56 can be stable after the use starting time.

Meanwhile, the second stirring/transporting film 92 is bent in the direction opposite to the rotational direction X of the second rotating member 90, and the bending tendency that is the same as that of the using time is made, so that an unnecessary load is not imparted to the toner.

In the structure of FIG. 6B, since the distal end portion 56A of the first stirring/transporting film 56 is positioned in the escape area 93 so that the tendency to bend in the same bending direction as that of the developing device 10 when used is not easily introduced to the first stirring/transporting film 56, the elasticity restoring force can be maintained, so that the toner transport force of the first stirring/transporting film 56 can be stable from start of use.

Meanwhile, since the second stirring/transporting film 92 is positioned in the escape area 91 so that the tendency to bend in the same bending direction as that of the developing device 10 when used is not easily introduced to the second stirring/transporting film, the elasticity restoring force can be maintained so that the toner transport force of the second stirring/transporting film can be stable from start of use, whereby the toner remaining amount of the housing 16 can be reduced.

In the structure of FIG. 6C, since the distal end portion 56A of the first stirring/transporting film 56 is positioned in the escape area 93 so that the tendency to bend in the same bending direction as that of the developing device 10 when used is not easily introduced to the first stirring/transporting film 56, the elasticity restoring force can be maintained, and the toner transport force of the first stirring/transporting film 56 can be stable from start of use.

Meanwhile, since the second stirring/transporting film 92 is bent in the same direction as the rotational direction X, the tendency to bend in the same bending direction as that of using the developing device 10 is not easily made, and the elastic restoring force can be maintained, so that the toner transport force can be stable from start of use.

The manufacturing method and the recycling method of the developing device 10 similar to those of the second embodiment can be utilized.

Next, a fourth exemplary embodiment of the powder supply unit of the invention will be described with reference to the drawings.

The same reference numerals as those of the above-described first exemplary embodiment will be assigned to the basically same parts as those of the first exemplary embodiment, and description thereof will be omitted.

Figure 7A:
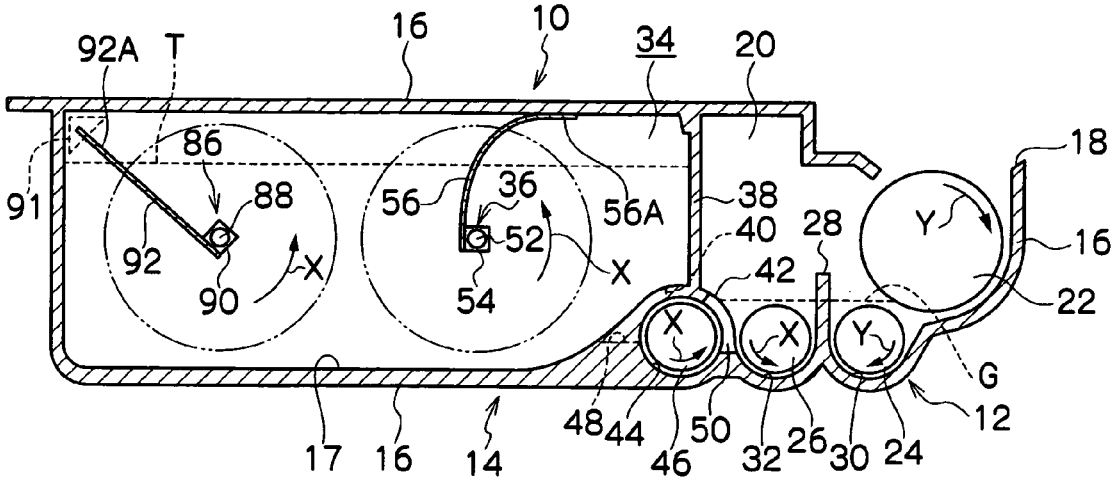
FIGS. 7A-7B are cross-sectional views of a developing device according to a fourth exemplary embodiment of the invention.
Figure 7B:
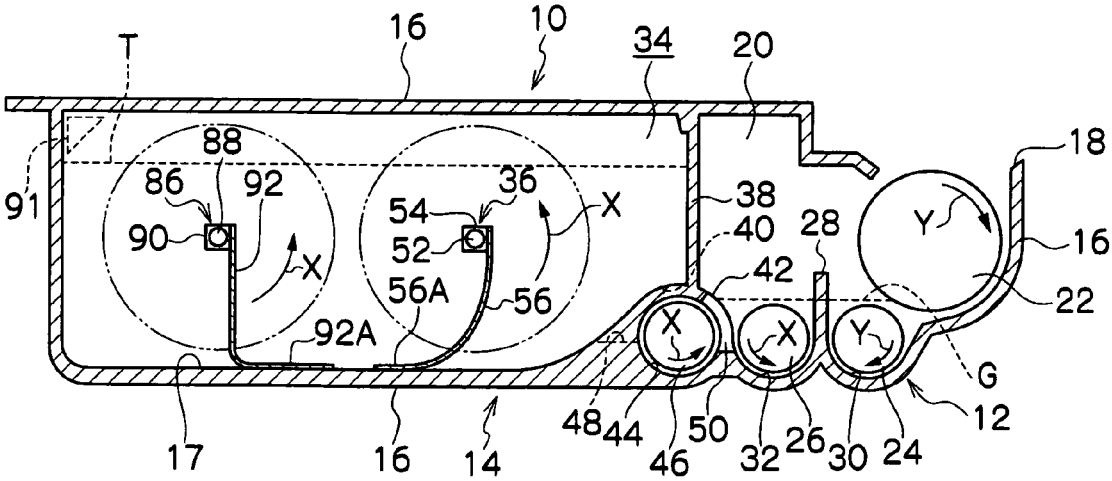

FIGS. 7A and 7B show a developing device 10 in which bending states of the first stirring/transporting film 56 and the second stirring/transporting film 92 are changed.

Here, as described above, the first stirring/transporting film 56 is the front transporting member, and the second stirring/transporting film 92 is the rear transporting member.

In the developing device 10 of FIGS. 7A and 7B, the distal end portion 56A of the first stirring/transporting film 56 is bent and held in the direction opposite to the rotational direction.

On the other hand, in FIG. 7A, the distal end portion 92A of the second stirring/transporting film 92 is held so as to be positioned in the escape area 91 which is a corner portion of the housing 16.

In FIG. 7B, the distal end portion 92A of the second stirring/transporting film 92 is bent in the same direction as the rotational direction X of the second agitator 86, and is in contact with a bottom surface side of the inner wall 17 of the housing 16 to be supported thereby.

In FIGS. 7A, 7B, the first rotating member 54 and second rotating member 90 rotate in the same phase.

Next, the operation of the fourth exemplary embodiment of the invention will be explained.

In FIG. 7A, when the developing device 10 is not used, the distal end portion 56A of the first stirring/transporting film 56 is bent and held in the direction opposite to the rotational direction X, and the distal end portion 92A of the second stirring/transporting film 92 is held in the escape area 91.

Here, when the unillustrated motor is driven so that the first agitator 36 and the second agitator 86 rotate in the X direction, the first stirring/transporting film 56 rotates in the same bending state, and the distal end portion 92A of the second stirring/transporting film 92 comes in contact with the side surface or the bottom surface of the inner wall 17 to be bent in the direction opposite to the rotational direction X.

Thus, the first agitator 36 and the second agitator 86 rotate one rotation or more in the X direction so that both the first stirring/transporting film 56 and second stirring/transporting film 92 are in the state in which both are bent in the direction opposite to the rotational direction X. Hereafter, by the rotation in the X direction, the toner T is supplied to the toner supplying hole 48.

Here, the first stirring/transporting film 56 can supply toner to the toner supplying hole 48 side while stirring without imparting a large load to toner.

Meanwhile, in the second stirring/transporting film 92, since the distal end portion 92A is positioned in the escape area 91 which is a corner portion of the housing 16, the distance from the second rotating member 90 to the corner of the housing 16 is long, so that the contact area of the free end of the second stirring/transporting film 92 and the side wall or the like of the housing 16 is reduced, whereby the curve of the second stirring/transporting film 92 is small.

Since the tendency to bend in the bending direction of the using time is not made, the elasticity restoring force can be maintained, and the toner transport force is not deteriorated after the use of the developing device 10 is started, whereby stable toner transportation is carried out.

In FIG. 7B, when the developing device 10 is not used, the distal end portion 56A of the first stirring/transporting film 56 is bent and held in the direction opposite to the rotational direction X, and the distal end portion 92A of the second stirring/transporting film 92 is in contact with the bottom surface side of the inner wall 17 of the housing 16 to be bent and held in the same direction as the rotational direction.

Here, when the unillustrated motor is driven so that the first agitator 36 and the second agitator 86 rotate in the X direction, the first stirring/transporting film 56 rotates in the same bending state.

On the other hand, in the second stirring/transporting film 92, when the distal end portion 92A becomes in a state not in contact with the bottom surface of the inner wall 17, the hold state of the distal end portion 92A is released, and by the rotation the distal end portion 92A comes in contact with the upper surface of the inner wall 17 to be bent in the direction opposite to the rotational direction.

Thus, the first agitator 36 and the second agitator 86 rotate one rotation or more in the X direction so that both the first stirring/transporting film 56 and second stirring/transporting film 92 are in the state in which both are bent in the direction opposite to the rotational direction X. Hereafter, by the rotation in the X direction, the toner T is supplied to the toner supplying hole 48.

Here, the first stirring/transporting film 56 can supply toner to the toner supplying hole 48 side while stirring it without imparting a large load to toner.

Meanwhile, in the second stirring/transporting film 92, since it is bent in the direction opposite to that of when it is used, the tendency to bend in the bending direction of use is not made, so that the toner transport force is not deteriorated after the use of the developing device 10 is started, whereby stable toner transportation is carried out.

As described above, in the fourth exemplary embodiment of the invention, since the phases of the plural sheet-like transporting members 56, 92 are matched, the toner transport force is constant.

Further, in the structure of FIG. 7A, since the first stirring/transporting film 56 is bent in the direction opposite to the rotational direction X so that the same bending tendency as that of the using time is made, whereby an unnecessary load is not imparted to the toner.

Meanwhile, since the distal end portion 92A of the second stirring/transporting film 92 is positioned in the escape area 91 which is a corner portion of the housing 16, the tendency to bend in the same bending direction as that of the developing device 10 when used is not easily introduced to the second stirring/transporting film 92, so that the elasticity restoring force can be maintained, and that the toner transport force of the second stirring/transporting film 92 can be stable from start of use, whereby the amount of toner remaining can be reduced.

Further, since the housing 16 has a flat, substantially rectangular shape in which the length of the bottom wall is longer than that of the side wall, when the free end of the second stirring/transporting film 92 is positioned toward any of corner portions of the housing 16, the distance from the second rotating member 90 to the corner of the housing 16 can be sufficiently long compared to the distance from the second rotating member 90 to the ceiling wall or the bottom wall of the housing 16, so that the contact area of the free end of the second stirring/transporting film 92 and the bottom wall, the side wall, or the like of the housing 16 is reduced, whereby the curve of the second stirring/transporting film can be small.

In the structure of FIG. 7B, since the first stirring/transporting film 56 is bent in the direction opposite to the rotational direction X so that the tendency to bend in the same direction as that of use is made, unnecessary load is not imparted to the toner.

On the other hand, since the second stirring/transporting film 92 is bent in the same direction as the rotational direction X, the tendency to bend in the same bending direction as that of the developing device 10 when used is not easily imparted, and the elasticity restoring force can be maintained, so that the toner transport force can be stable from start of use.

A manufacturing method and a recycling method of the developing device 10 similar to those of the second exemplary embodiment can be utilized.

Next, a fifth exemplary embodiment of a powder supply unit of the invention will be described with reference to the drawings.

Figure 8A:
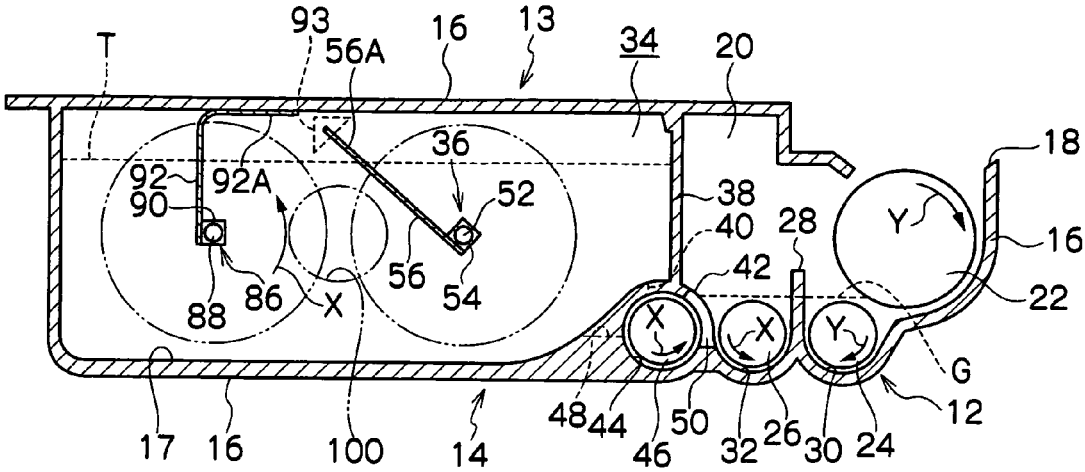
FIGS. 8A-8C are cross-sectional views of a developing device according to a fifth exemplary embodiment of the invention.

FIG. 8A shows a state of a developing device 13 before toner is filled.

A toner filling hole 100 is provided on one side surface supporting the rotating shafts 52, 88 in a housing 16 of the developing device 13.

An unillustrated drive gear is secured to an end portion of the first rotating shaft 52 by press-fitting or by a fixing means such as an E ring or the like, and is rotationally driven in the X direction by the rotation of an unillustrated motor being transmitted to the drive gear.

On the other hand, no gear is securely attached to an end portion of the second rotating shaft 88 so that the second rotating shaft 88 can rotate freely.

Unillustrated marks are provided at predetermined positions on end portions of the first rotating shaft 52 and the second rotating shaft 88 such that discrimination of the rotational positions of the first rotating member 86 and the second rotating member 54 can be made.

Here, an escape area 93 is provided to be positioned in an upper side with respect to the upper surface of the first rotating member 54 such that the distal end portion 56A of the first stirring/transporting film 56 is not in contact with the inner wall 17 or is in contact with it without bending. The distal end portion 56A of the first stirring/transporting film 56 is held so as to be positioned in the escape area 93. Thus, the distal end portion 56A of the first stirring/transporting film 56 does not block the toner filling hole 100.

The distal end portion 92A of the second stirring/transporting film 92 is in contact with the upper surface of the inner wall 17 so as not to block the toner filling hole 100.

Next, the operation of the fifth exemplary embodiment of the invention will be explained.

As shown in FIG. 8A, first, the developing device 13 is stood up in the vertical direction, and toner is filled in the toner accommodating chamber 34 through the toner filling hole 100 by an unillustrated toner replenishment unit. After a predetermined amount of toner is filled, toner replenishment is completed, and the toner filling hole 100 is sealed by an unillustrated cap.

Figure 8B:
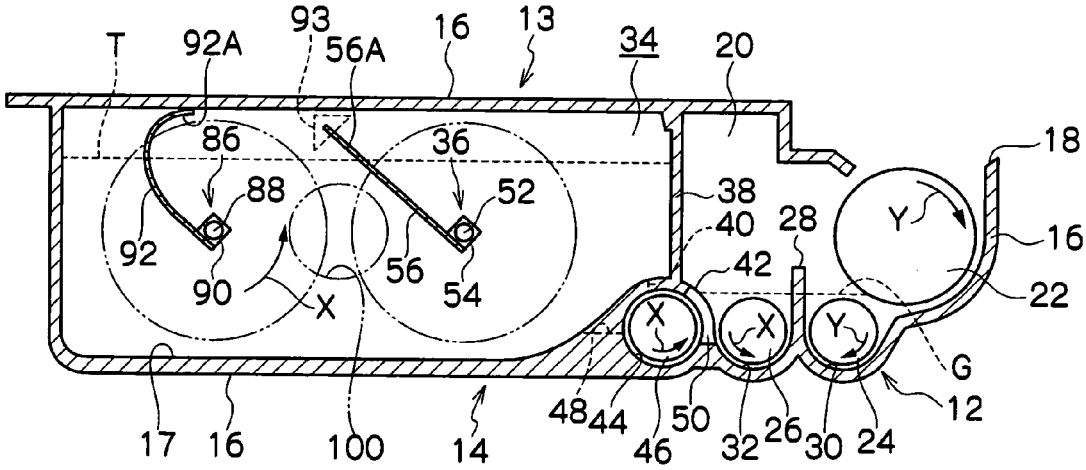

Subsequently, as shown in FIG. 8B, after the toner filling hole 100 is sealed, the second rotating shaft 88 is rotated based on the above-described mark to be held at a position at which it is possible to have rotation in the same phase as that of the first rotating member 54. A gear is securely attached to an end portion of the held second rotating shaft 88, and the gear provided on the end portion of the first rotating shaft 52 and another gear row mesh with each other so that the first rotating member 54 and the second rotating shaft 88 can rotate in the same phase.

After the gear has been securely attached, the developing device 13 is arranged in the horizontal direction. At this time, since the distal end portion 56A of the first stirring/transporting film 56 is positioned adjacent to the upper surface of the inner wall 17 of the housing 16, an area receiving a load by toner T is small, and the first stirring/transporting film 56 can be located in the escape area 93 to be held substantially flat.

Figure 8C:
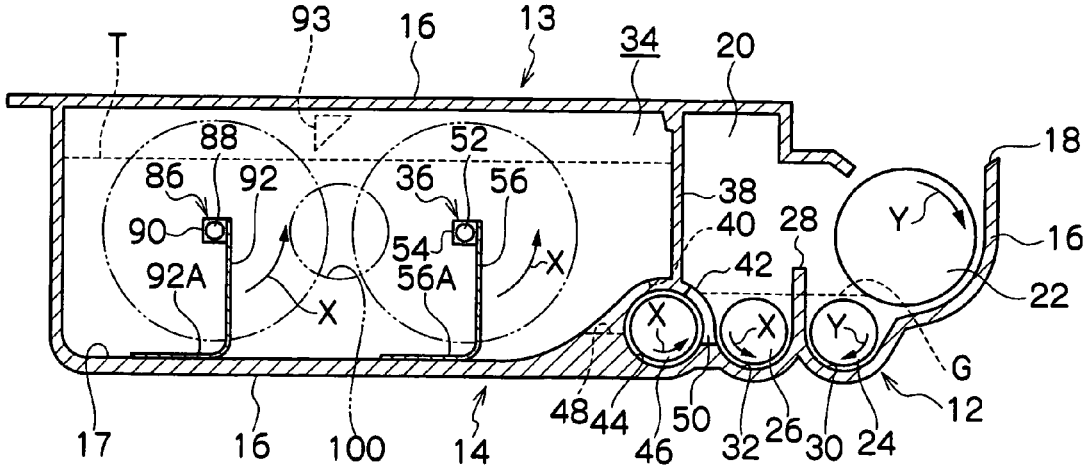

Subsequently, as shown in FIG. 8C, when the first rotating shaft 52 and the second rotating shaft 88 are rotated in the X direction by an unillustrated drive means, the distal end portion 56A of the first stirring/transporting film 56 and the distal end portion 92A of the second stirring/transporting film 92 are bent in the direction opposite to the rotational direction, and toner is stirred and transported to be supplied to the toner supplying hole 48.

As described above, in the fifth exemplary embodiment of the invention, since the distal end portion 56A of the first stirring/transporting film 56 is positioned in the escape area 93 provided above the upper surface of the rotating member before toner is filled, the load of the toner to the first stirring/transporting film 56 is decreased when toner is filled, so that the distal end portion 56A is not easily bent in the same bending direction as that when using.

Further, since the second rotating member 90 and the second stirring/transporting film 92 side are rotated to match the phases, the first stirring/transporting film 56 is held in a substantially flat state until the time of use.

Thus, the elastic restoring force of the first stirring/transporting film 56 is maintained, and the toner transport force of the first stirring/transporting film 56 can be stable after the use starting time, so that the toner transport force is not deteriorated, whereby stable image density control is possible.

Further, when toner is filled, since the first stirring/transporting film 56 and the second stirring/transporting film 92 are held at a position at which they do not block the toner filling hole 100, toner filling to the toner accommodating chamber 34 is not prevented, so that toner is filled smoothly and efficiently, whereby toner can be filled in a short period of time.

Next, a sixth exemplary embodiment of a powder supply unit of the invention will be described with reference to FIG. 9.

Figure 9:
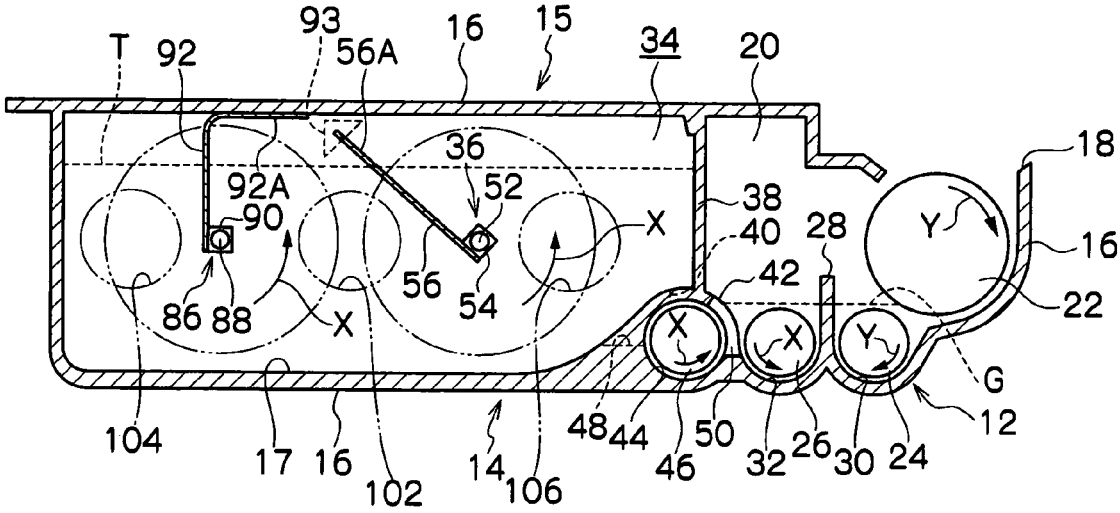
FIG. 9 is a cross-sectional view of a developing device according to a sixth exemplary embodiment of the invention.

FIG. 9 shows a state of a developing device 15 before toner is filled.

Toner filling holes 102, 104, 106 are provided on one side surface of the housing 16 supporting the first rotating shaft 52 and the second rotating shaft 88 of the developing device 15 such that they are arranged in a line so as to be on either side of the first rotating shaft 52 and the second rotating shaft 88.

Unillustrated marks are provided at predetermined positions on end portions of the first rotating shaft 52 and the second rotating shaft 88 such that the rotational positions of the first rotating member 86 and the second rotating member 54 can be discriminated.

Here, the distal end portion 56A of the first stirring/transporting film 56 and the distal end portion 92A of the second stirring/transporting film 92 are arranged and held so as not to block the toner filling holes 102, 104, 106.

Next, the operation of the sixth exemplary embodiment of the invention will be explained.

The developing device 15 is stood up in a vertical direction, and toner is filled in the toner accommodating chamber 34 through the toner filling hole 102, 104, 106 simultaneously by an unillustrated toner replenishment unit. A this time, since the respective transporting members are located at positions at which they do not block the toner filling hole 102, 104, 106, toner is not prevented from being filled.

Since toner is filled through the three toner filling holes 102, 104, and 106 simultaneously, the required filling time is only one third compared to a case where there is only one toner filling hole.

The filled toner enters from both sides of the respective transporting members and is stored while covering the respective transporting members, so that the respective transporting members do not bend to an extreme.

After a predetermined amount of toner is filled, toner replenishment is completed, and the toner filling holes 102, 104, 106 are sealed by unillustrated caps.

Subsequently, the developing device 15 is installed in the horizontal direction and becomes ready to be used.

As described above, the toner filling holes 102, 104, and 106 exist at plural positions on both sides of the first rotating member 54 and the second rotating member 90, and toner is filled through the toner filling holes at the plural positions simultaneously, so that toner can be filled in a shorter period of time. Here, toner can be filled without being disturbed by the first stirring/transporting film 56 and the second stirring/transporting film 92.

When toner is filled, since toner enters from both sides of the respective transporting members simultaneously so that the respective transporting members are pressed by the toner from both sides and thus prevented from bent extremely at one side, whereby the shape of the respective transporting members can be maintained even after toner is filled.

Further, since the shape of the respective transporting members can be maintained, the toner transport force at the time of use is not deteriorated, and stable image density control is possible.

Next, a seventh exemplary embodiment of a powder supply unit of the invention will be described with reference to the drawing FIG. 10.

Figure 10:
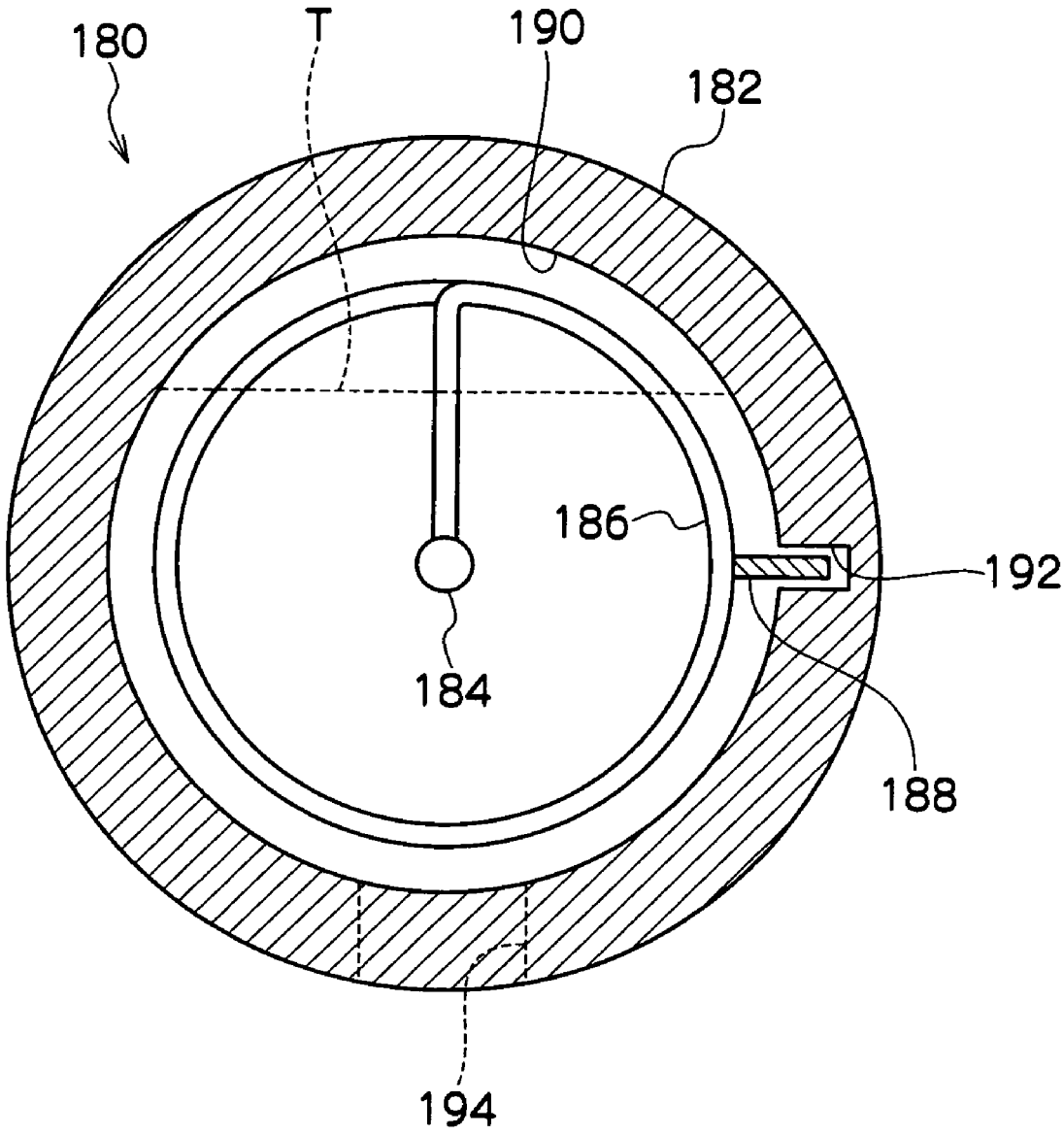
FIG. 10 is a cross-sectional view of a toner cartridge according to a seventh exemplary embodiment of the invention.

FIG. 10 shows a toner cartridge 180 supplying toner T to an unillustrated developing unit.

The toner cartridge 180 has a cylindrical housing 182 storing the toner T, a spiral agitator 186 provided inside the housing 182, a flexible stirring/transporting film 188 which is secured to an outer peripheral portion of the agitator 186 by fixing means such as gluing or the like, and a toner supplying hole 194 for supplying the toner T to the developing unit.

The spiral agitator 186 is provided with a rotating shaft 184 and is rotatably supported on a peripheral wall of the housing 182.

An unillustrated gear is fixed on an end portion of the rotating shaft 184, and a rotational force from an unillustrated motor is transferred to the gear so as to rotate the agitator 186 via the gear.

An escape groove 192 recessed in the radial direction, with the rotating shaft 184 of the agitator 186 as the centre, is provided on an inner wall of the housing 182, and a free end side of the stirring/transporting film 188 is positioned in the escape groove 192 so as not to be in contact with the inner wall of the housing 182 or to be in contact with it but without bending.

The free end side of the stirring/transporting film 188 can be slidingly moved on the inner wall of the housing 182 by the rotation of the agitator 186.

A toner supplying hole 190 is provided in a lower side of the housing 182 and on a downstream side in the transporting direction of the toner T.

Next, the operation of the seventh exemplary embodiment of the invention will be explained.

When the toner cartridge 180 is not used, the distal end portion of the stirring/transporting film 188 is held in the escape groove 192.

Here, when the unillustrated motor is driven so that the agitator 186 is rotated, the distal end portion of the stirring/transporting film 188 comes in contact with the inner wall of the housing 182 so as to be bent in the direction opposite to the rotational direction of the agitator 186.

Thus, due to the agitator 186 being rotated, the stirring/transporting film 188 is caused to assume a state in which it bends in the direction opposite to the rotational direction of the agitator 186, and slidingly moved on the inner wall of the housing 182 to stir and transport the toner T. Thus, the toner T is supplied to the toner supplying hole 194.

Here, in the stirring/transporting film 188, since the distal end portion thereof is positioned in the escape groove 192, the tendency to bend in the bending direction of the time of use is not made, so that the toner transport force is not deteriorated after the use of the toner cartridge 180 is started, whereby stable toner transportation is carried out.

The invention is not limited to the above-described embodiments.

The shape of the first rotating member 54 and the second rotating member 90 is not limited to a rectangular parallelepiped, and may be a multi-angled pole, or may be a cylindrical pole.

The first stirring/transporting film 56 and the second stirring/transporting film 92 may be fixed not only on a right side of the respective rotating members but also on a lower side or a left side thereof as seen in the cross-sectional views The angles of the first slit 60 and the second slit 62 may be appropriately selected between 0° and 90° depending on the transportation state of the toner T.

The angles of the first slit 60 and the second slit 62 may be different from each other.

The toner filling holes 100, 102, 104, and 106 may be arranged in a different manner horizontally or vertically in the cross-sectional area of the toner accommodating chamber 34 other than the illustrated positions.

What is claimed is:

1. A powder supply unit comprising:

a housing that accommodates powder;

a plurality of rotating members that are rotatably provided in the housing;

a plurality of flexible sheet-like transporting members each fixed to one of the rotating members and having a free end at a side different from the fixed portion side, the free end side being slidingly moved on an inner wall of the housing by the rotation of the rotating member, transporting the powder in the axial direction of the rotating member; and a powder supplying hole provided on the downstream side in the transporting direction of the powder in the housing, at least one of the sheet-like transporting members when not in use being in a hold state in which the free end side thereof is bent in a direction opposite to the direction of bending when in use, wherein when aligning the plurality of flexible sheet-like transporting members before the use of the powder supply unit is started, the position is fixed of the sheet-like transporting member that is in the hold state in which the free end side thereof is positioned in an escape area, and another sheet-like transporting member is rotated to carry out alignment.

2. A recycling method of a powder supply unit comprising:

a housing that accommodates powder;

a plurality of rotating members that are rotatably provided in the housing, the plurality of rotating members rotating with the phases thereof matched;

a plurality of flexible sheet-like transporting members each fixed to one of the rotating members and having a free end at a side different from the fixed portion side, a plurality of slits having an inclined angle with respect to an axial direction of the rotating member being formed at the free end, the free end side being slidingly moved on an inner wall of the housing by the rotation of the rotating member, transporting the powder in the axial direction of the rotating member; and a powder supplying hole provided on a downstream side in the transporting direction of the powder in the housing, the housing having a substantially rectangular flat shape in which a dimension of a bottom wall of the housing is longer than that of a side wall thereof when viewed along the axial direction of the rotating member, the housing including a curved wall that extends from a bottom portion of the side wall to the bottom wall, and the powder supplying hole being formed at the curved wall and the housing being provided with the rotating member at a predetermined position spaced apart from the bottom wall and the side wall, the sheet-like transporting member when not in use being in a hold state in which the free end thereof is positioned toward any of the corners formed by the side wall and an upper wall of the substantially rectangular housing, and the sheet-like transporting member positioned in the vicinity of the powder supplying hole comprises the plurality of slits having an angle with respect to the axial direction of the rotating member it is fixed to, and an angle of at least one of the plurality of slits is opposite to the angle of the other of the plurality of slits, the angles of the plurality of slits are reversed around a position at which the sheet-like transporting member faces the powder supplying hole, the method comprising:

filling powder, when recycling the powder supply unit, after the free end side of the sheet-like transporting member is bent in a direction opposite to the direction of bending when in use.

3. The method of claim 2, wherein a powder filling hole for filling powder into the housing is provided, and the free end of the sheet-like transporting member being held at a position at which the sheet-like transporting member does not obstruct the powder filling hole.

4. The method of claim 1, wherein a plurality of powder filling holes for filling powder into the housing are provided on opposite sides of the rotating member.

5. The method of claim 4, the method further comprising: providing the powder supply unit; and filling powder through at least two of the powder filling holes simultaneously.

6. The method of claim 1, wherein the plurality of slits comprises slits of different lengths.

* * * * *